US010203644B2

(12) United States Patent
Endo et al.

(10) Patent No.: US 10,203,644 B2
(45) Date of Patent: Feb. 12, 2019

(54) SHEET PROCESSING APPARATUS AND IMAGE FORMING SYSTEM INCLUDING THE SAME

(71) Applicant: CANON FINETECH NISCA INC., Misato-shi (JP)

(72) Inventors: Kazunori Endo, Minamikoma-gun (JP); Kenichi Matsuno, Minamikoma-gun (JP); Ikuhiro Obata, Minamikoma-gun (JP); Yuji Kunugi, Minamikoma-gun (JP)

(73) Assignee: Canon Finetech Nisca Inc., Misato-shi (JP)

( * ) Notice: Subject to any disclaimer, the term of this patent is extended or adjusted under 35 U.S.C. 154(b) by 77 days.

(21) Appl. No.: 15/348,007

(22) Filed: Nov. 10, 2016

(65) Prior Publication Data

US 2017/0185023 A1 Jun. 29, 2017

(30) Foreign Application Priority Data

Dec. 25, 2015 (JP) ..... 2015-253414
Dec. 25, 2015 (JP) ..... 2015-253443

(51) Int. Cl.

| | |
|---|---|
| ***B65H 45/18*** | (2006.01) |
| ***B65H 37/06*** | (2006.01) |
| ***G03G 15/00*** | (2006.01) |
| ***B31F 1/00*** | (2006.01) |
| ***B65H 37/04*** | (2006.01) |

(Continued)

(52) U.S. Cl.

CPC ..... *G03G 15/6541* (2013.01); *B31F 1/0045* (2013.01); *B31F 1/0048* (2013.01);

(Continued)

(58) Field of Classification Search

CPC ..... B65H 37/06; B65H 2301/4505; B65H 2301/45; B65H 2301/43828; B65H 2404/141; B65H 2404/1112; B65H 45/18

See application file for complete search history.

(56) References Cited

U.S. PATENT DOCUMENTS 7,326,167 B2 2/2008 Suzuki et al.
7,594,645 B2 9/2009 Suzuki et al.

(Continued)

FOREIGN PATENT DOCUMENTS

JP 2001-240292 A 9/2001
JP 2003-276943 A 10/2003

(Continued)

OTHER PUBLICATIONS

Office Action dated Dec. 11, 2017, in Japanese Patent Application No. 2015-253443.

(Continued)

*Primary Examiner* — Jennifer E Simmons

(74) *Attorney, Agent, or Firm* — Venable LLP

(57) ABSTRACT

A sheet processing apparatus, including: a conveyance path in which a sheet is conveyed in a predetermined conveyance direction; a rotary member pair configured to nip the sheet conveyed in the conveyance path and rotate to perform folding processing on the sheet; and a guide portion provided between one rotary member of the rotary member pair and the conveyance path and configured to guide a downstream edge of a sheet conveyed in the predetermined conveyance direction, wherein, in case that a sheet is conveyed in the conveyance path in the predetermined conveyance direction, the guide portion guides a downstream edge of the sheet in the predetermined conveyance direction in a state in which the guide portion is held in contact with the one rotary member.

7 Claims, 16 Drawing Sheets

(52) U.S. Cl.
CPC ..... *B65H 37/04* (2013.01); *B65H 37/06* (2013.01); *B65H 45/18* (2013.01); *G03G 15/6529* (2013.01); *B65H 2301/43828* (2013.01); *B65H 2301/45* (2013.01); *B65H 2403/512* (2013.01); *B65H 2404/1112* (2013.01); *B65H 2404/141* (2013.01); *B65H 2801/27* (2013.01); *G03G 2215/00827* (2013.01); *G03G 2215/00877* (2013.01)

(56) References Cited

U.S. PATENT DOCUMENTS

2009/0033018 A1* 2/2009 Taguchi ..... B41L 43/02
270/58.08
2014/0171285 A1 6/2014 Furlotti

FOREIGN PATENT DOCUMENTS

| | | | | |
|---|---|---|---|---|
| JP | 2005-001841 | A | | 1/2005 |
| JP | 2005-239413 | A | | 9/2005 |
| JP | 2009-126687 | A | | 6/2009 |
| JP | 2010-120714 | A | | 6/2010 |
| JP | 2010120714 | A | * | 6/2010 |

OTHER PUBLICATIONS

Office Action dated Oct. 31, 2017, in Japanese Patent Application No. 2015-253414.
U.S. Appl. No. 15/348,036, filed Nov. 10, 2016.

* cited by examiner

SHEET PROCESSING APPARATUS AND IMAGE FORMING SYSTEM INCLUDING THE SAME

BACKGROUND OF THE INVENTION

Field of the Invention

The present invention relates to a sheet processing apparatus configured to perform folding processing on a sheet or a bundle of sheets delivered from an image forming apparatus, and further relates to an image forming system including the sheet processing apparatus.

Description of the Related Art

Hitherto, there has been provided a sheet processing apparatus configured to perform folding processing on a bundle of sheets to form a booklet, as post-processing for a sheet delivered from image forming apparatus such as a copying machine, a printer, a facsimile, and a multifunctional peripheral of those devices. For example, there has been known a sheet processing apparatus configured to align a plurality of sheets sequentially conveyed from an image forming apparatus to form a bundle of sheets, perform binding processing with a stapling device, fold the bundle of sheets at a bound portion thereof and thrust the bundle of sheets to a press-contact portion of a folding roller pair with a thrust plate, and fold the bundle of sheets in half while conveying the bundle of sheets with the folding roller pair (Japanese Patent Application Laid-Open No. 2009-126687).

In the sheet processing apparatus, the folding roller pair is disposed on one side across a sheet stack guide as a stacking tray for sheets to be subjected to the binding processing and the folding processing, from the thrust plate which is disposed on the other side opposite to the folding roller pair. In order to prevent sheet jamming which may be caused by a contact of a sheet to be conveyed to the sheet stack guide with the folding roller pair, an opening and closing shutter is disposed as a regulating member between the folding roller pair and the sheet stack guide.

In the conventional apparatus described in Japanese Patent Application Laid-Open No. 2009-126687, the opening and closing shutter is disposed so as to be raised and lowered by a motor along a sheet carry-in direction of the sheet stack guide. When a sheet is to be conveyed to the sheet stack guide, the opening and closing shutter is raised to block a thrusting path of the thrust plate which advances toward the press-contact portion of the folding roller pair serving as a rotary member pair. When the folding processing is to be performed, the opening and closing shutter is lowered to open the thrusting path. Raising and lowering of the opening and closing shutter are performed by controlling driving of the motor.

However, the opening and closing shutter is raised and lowered for each of the folding processing operation, and hence it is not easy to always stably stop the opening and closing shutter at a predetermined position with respect to the folding roller pair when the thrusting path is to be blocked. In particular, when there is variation in position of the opening and closing shutter at the time of conveying a sheet, a leading edge of the sheet to be conveyed may be caught by outer circumferential surfaces of the folding roller pair or by the opening and closing shutter. Thus, there is a concern of causing sheet jamming.

SUMMARY OF THE INVENTION

The present invention has been made in view of the above-mentioned problem of the conventional art, and an object of the present invention is to suppress variation in position of a guide portion configured to prevent a sheet to be conveyed from being caught by a rotary member pair in a sheet processing apparatus including the rotary member pair.

According to one embodiment of the present invention, there is provided a sheet processing apparatus, comprising:

a conveyance path in which a sheet is conveyed in a predetermined conveyance direction;

a rotary member pair configured to nip a sheet conveyed in the conveyance path and rotate to perform folding processing on the sheet; and a guide portion provided between one rotary member of the rotary member pair and the conveyance path and configured to guide a downstream edge of a sheet conveyed in the predetermined conveyance direction, wherein, in case that a sheet is conveyed in the conveyance path in the predetermined conveyance direction, the guide portion guides a downstream edge of the sheet in the predetermined conveyance direction in a state in which the guide portion is held in contact with the one rotary member.

Further features of the present invention will become apparent from the following description of exemplary embodiments with reference to the attached drawings.

DESCRIPTION OF THE EMBODIMENTS

Now, the embodiments of the present invention will be described in detail with reference to the accompanying drawings. In the accompanying drawings, components which are the same or similar throughout the specification are denoted by the same reference symbols.

Figure 1:
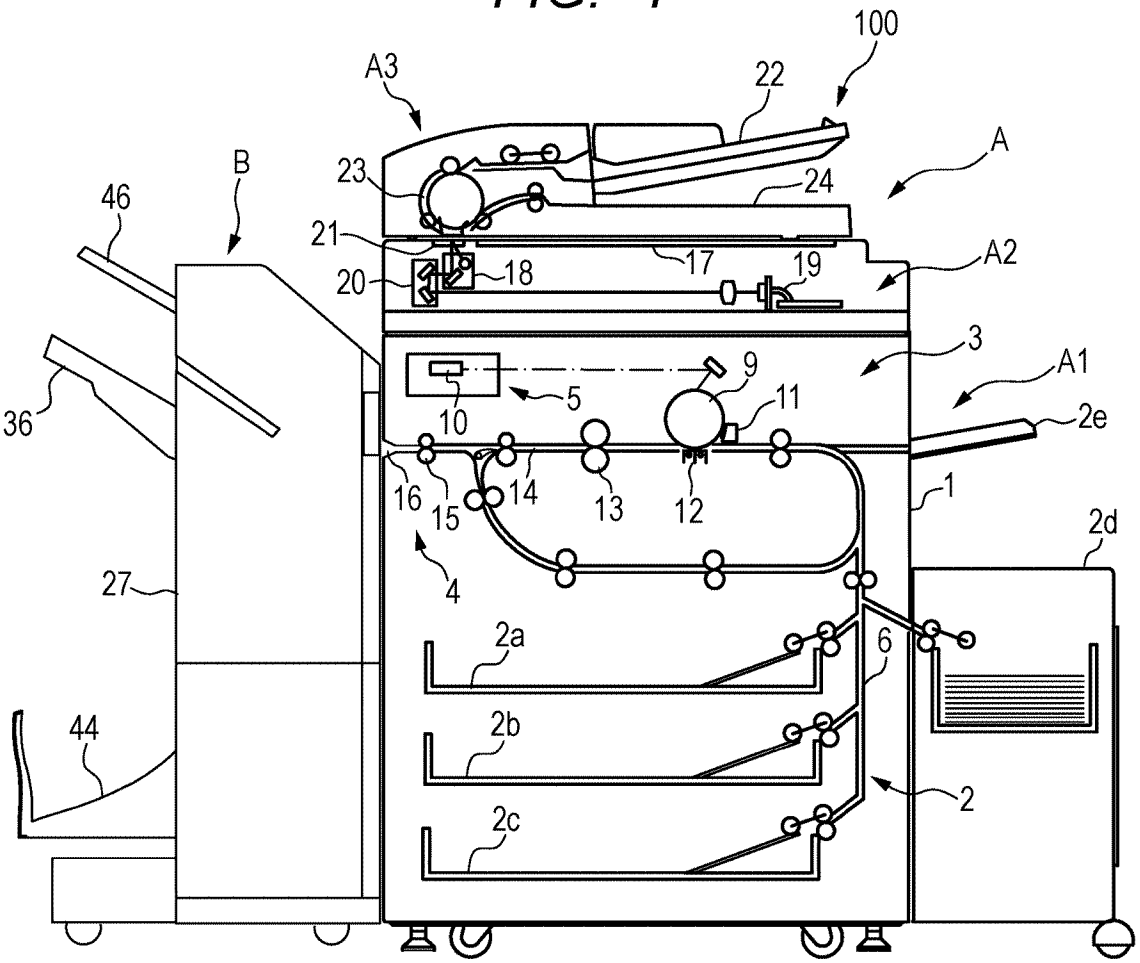
FIG. 1 is an explanatory view for illustrating an overall configuration of an image forming system according to an embodiment.

FIG. 1 is a view for schematically illustrating an overall configuration of an image forming system 100 including a sheet processing apparatus according to an embodiment of the present invention. As illustrated in FIG. 1, the image forming system 100 includes an image forming apparatus A and a sheet processing apparatus B juxtaposed to the image forming apparatus A. The image forming apparatus A includes an image forming unit A1, a scanner unit A2, and a feeder unit A3. In an apparatus housing 1 of the image forming unit A1, there are provided a sheet feeding portion 2, an image forming portion 3, a sheet delivery portion 4, and a data processing portion 5.

The sheet feeding portion 2 includes a plurality of cassette mechanisms 2*a*, 2*b*, and 2*c* configured to receive image forming sheets (recording medium such as paper) having different sizes, respectively, and is configured to send out a sheet having a size designated by a main body controller (not shown) to a sheet feeding path 6. Each of the cassette mechanisms 2*a*, 2*b*, and 2*c* is removably mounted in the sheet feeding portion 2 and includes a separating mechanism configured to separate sheets one by one and a sheet feeding mechanism configured to send out the sheets. On the sheet feeding path 6, there are disposed conveyance rollers configured to feed sheets, which are fed from the respective cassette mechanisms 2*a*, 2*b*, and 2*c*, to downstream, and a registration roller pair disposed at an end portion of the path and configured to align edges of the sheets.

A large capacity cassette 2*d* and a manual feed tray 2*e* are connected to the sheet feeding path 6. The large capacity cassette 2*d* is constructed by an option unit configured to receive certain size sheets which are consumed in large amounts. The manual feed tray 2*e* is configured to enable feeding of special sheets, such as thick sheets, coated sheets, or film sheets, which are difficult to be separated and fed.

The image forming portion 3 is constructed by, for example, an electrostatic printing mechanism. The image forming portion 3 is configured to form an image on a sheet as a recording medium through an electrophotographic method. The image forming portion 3 includes a photosensitive drum 9 to be rotated. In the periphery of the photosensitive drum 9, there are disposed a light emitting device 10 configured to emit an optical beam, a developing device 11, and a cleaner (not shown). In the embodiment, the image forming portion 3 includes a monochromatic printing mechanism. However, the image forming portion 3 is not limited to include the monochromatic printing mechanism, and may include a color printing mechanism. A latent image is optically formed on the photosensitive drum 9 by the light emitting device 10, and the developing device 11 causes toner to adhere on the latent image.

A sheet is fed from the sheet feeding path 6 to the image forming portion 3 at a timing of forming an image on the photosensitive drum 9, and the image is transferred onto the sheet by a transfer charger 12. The image is fixed by a fixing roller 13 disposed on a sheet delivery path 14. On the sheet delivery path 14, there are disposed a sheet delivery roller 15 and a sheet delivery port 16 to convey the sheet having the image formed thereon to the sheet processing apparatus B described later.

The scanner unit A2 is an image reading portion configured to read an image of an original. The scanner unit A2 includes a platen 17 on which an original is placed, a carriage 18 configured to reciprocate along the platen 17, a photoelectric conversion element 19, and a reduction optical system 20 configured to guide light, which is emitted from the carriage 18 and reflected from the original placed on the platen 17, to the photoelectric conversion element 19. The photoelectric conversion element 19 is configured to convert optical output from the reduction optical system 20 into image data through photoelectric conversion and output the image data as an electric signal to the image forming portion 3.

Further, the scanner unit A2 includes a running platen 21 to read a sheet fed from the feeder unit A3. The feeder unit A3 includes a sheet feeding tray 22, a sheet feeding path 23 configured to guide the sheet fed from the sheet feeding tray 22 to the running platen 21, and a sheet delivery tray 24 configured to receive the original having passed through the running platen 21. The original fed from the sheet feeding tray 22 is read by use of the carriage 18 and the reduction optical system 20 when the original passes through the running platen 21.

Figure 2:
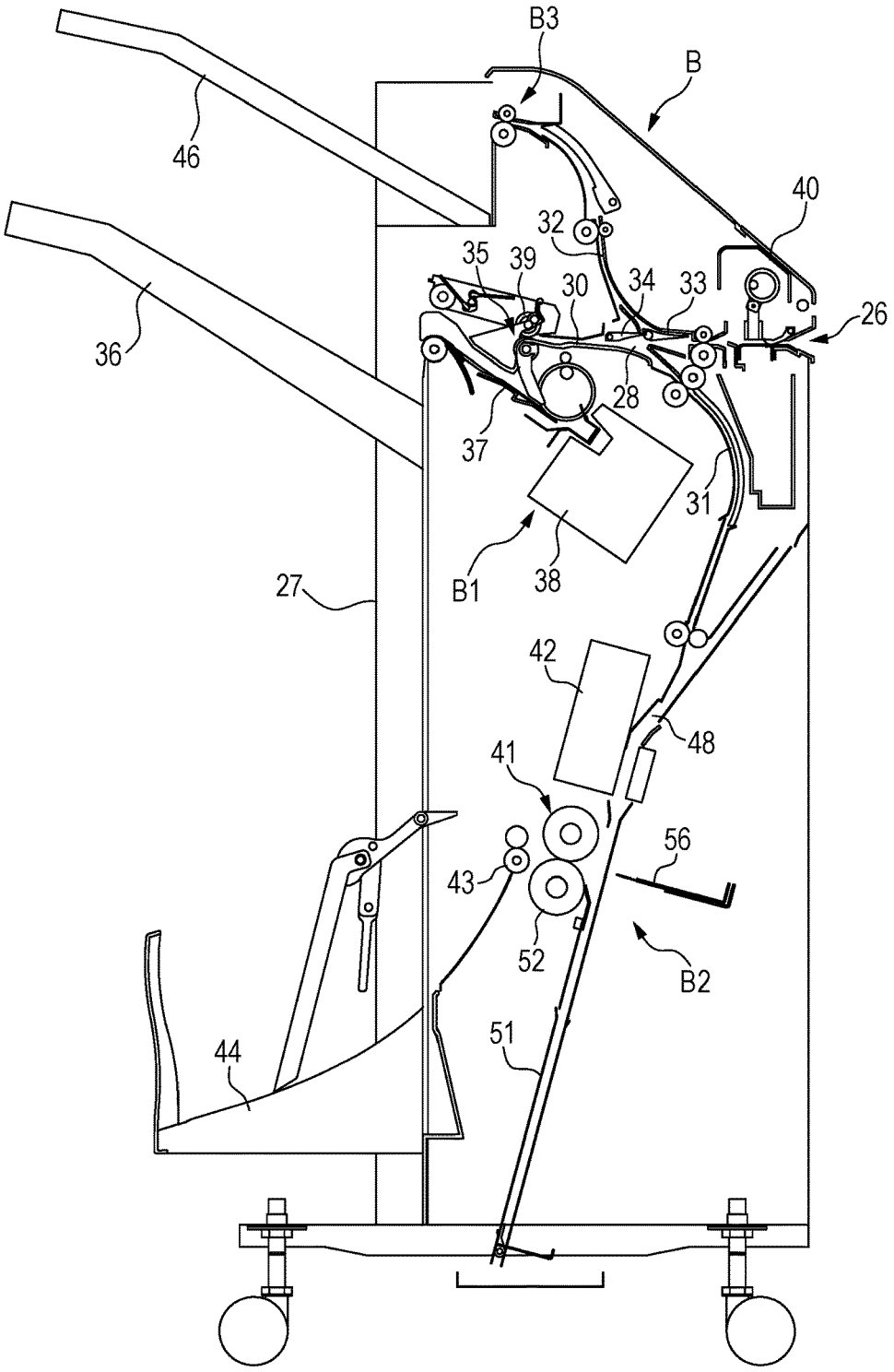
FIG. 2 is an explanatory view for illustrating an overall configuration of a sheet processing apparatus in the image forming system of FIG. 1.

FIG. 2 is an illustration of a configuration of the sheet processing apparatus B configured to perform post-processing on a sheet, which is conveyed from the image forming apparatus A and has an image formed thereon. The sheet processing apparatus B includes an apparatus housing 27 having a carry-in port 26 configured to introduce a sheet from the image forming apparatus A. The apparatus housing 27 is disposed to be aligned with the apparatus housing 1 of the image forming apparatus A so as to allow the carry-in port 26 to communicate with the sheet delivery port 16 of the image forming apparatus A.

The sheet processing apparatus B includes a sheet carry-in path 28 configured to convey a sheet introduced through the carry-in port 26, a first sheet delivery path 30, a second sheet delivery path 31, and a third sheet delivery path 32, which are formed to branch off from the sheet carry-in path 28, a first path-switching unit 33, and a second path-switching unit 34. The first path-switching unit 33 and the second path-switching unit 34 are each constructed by a flapper guide configured to switch conveyance directions of a sheet conveyed in the sheet carry-in path 28.

The first path-switching unit 33 is configured to be switched by a drive unit (not shown) between a mode of guiding a sheet from the carry-in port 26 to the directions of the first sheet delivery path 30 and the second sheet delivery path 31, and a mode of guiding the sheet to the third sheet delivery path 32. The first sheet delivery path 30 and the second sheet delivery path 31 communicate with each other so as to enable switch-back conveyance of reversing the conveyance direction of a sheet which has once been introduced to the first sheet delivery path 30 and introducing the sheet to the second sheet delivery path 31.

The second path-switching unit 34 is disposed downstream of the first path-switching unit 33 in the conveyance direction of a sheet conveyed in the sheet carry-in path 28.

The second path-switching unit 34 is similarly configured to be switched by a drive unit (not shown) between a mode of introducing a sheet having passed through the first path-switching unit 33 to the first sheet delivery path 30, and a mode of performing the switch-back conveyance of introducing a sheet which has once been introduced to the first sheet delivery path 30 to the second sheet delivery path 31.

The sheet processing apparatus B includes a first processing portion B1, a second processing portion B2, and a third processing portion B3 which are configured to perform different types of post-processing. Further, on the sheet carry-in path 28, there is disposed a punching unit 40 configured to form a punch hole in the conveyed sheet.

The first processing portion B1 is a binding processing portion configured to collect a plurality of sheets conveyed from a sheet delivery port 35 located at a downstream end of the first sheet delivery path 30 in the conveyance direction of sheets conveyed in the sheet carry-in path 28, align the sheets, perform binding processing, and deliver the sheets to the stacking tray 36 disposed on an outer side of the apparatus housing 27. The first processing portion B1 includes a sheet conveying device 37 configured to convey a sheet or a bundle of sheets, and a binding processing unit 38 configured to perform binding processing on a bundle of sheets. At the downstream end of the first sheet delivery path 30, there is disposed a delivery roller pair 39 configured to deliver a sheet from the sheet delivery port 35 and to perform the switch-back conveyance from the first sheet delivery path 30 to the second sheet delivery path 31.

The second processing portion B2 is a folding processing portion configured to form a plurality of sheets conveyed through the switch-back conveyance from the second sheet delivery path 31 into a bundle of sheets, perform binding processing on the bundle of sheets, and then perform folding processing. As described later, the second processing portion B2 includes a folding processing device 41 configured to perform folding processing on a sheet or a bundle of sheets having been conveyed, and a binding processing unit 42 which is disposed on immediate upstream of the folding processing device 41 along the sheet conveyance direction of the sheet conveyed to the second sheet delivery path 31 and is configured to perform binding processing on a bundle of sheets. The bundle of sheets subjected to folding processing is delivered by a delivery roller pair 43 to a stacking tray 44 disposed on the outer side of the apparatus housing 27.

The third processing portion B3 is configured to perform jog-sorting on sheets conveyed from the third sheet delivery path 32 to group the sheets into a group of sheets to be collected while being offset by a predetermined amount in a direction orthogonal to the conveyance direction and a group of sheets to be collected without being offset. The sheets having been subjected to the jog-sorting are delivered to the stacking tray 46 disposed on the outer side of the apparatus housing 27. Thus, a bundle of sheets being offset and a bundle of sheets not being offset are stacked.

Figure 3:
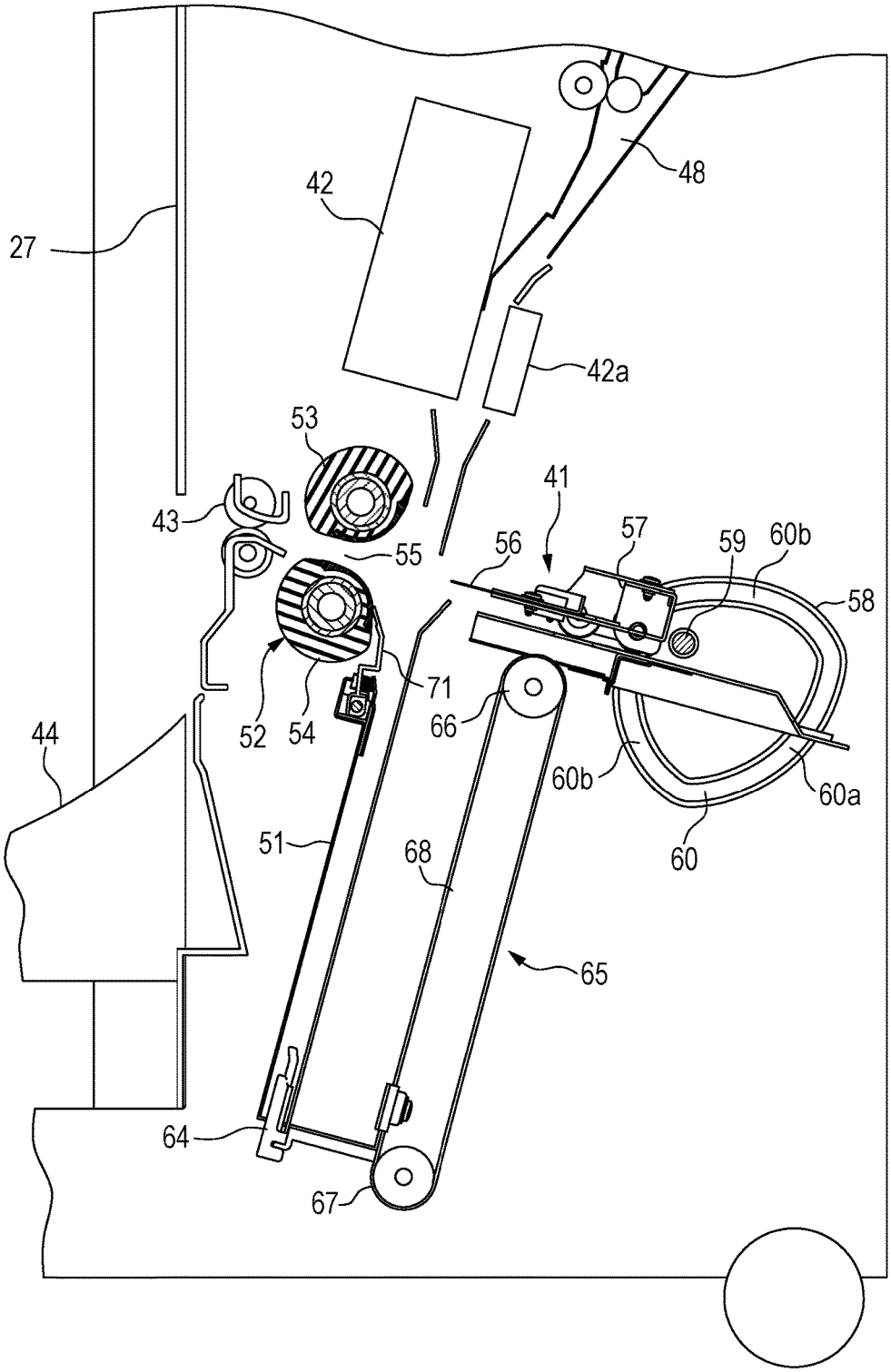
FIG. 3 is a sectional view for illustrating a folding processing device of the sheet processing apparatus of FIG. 2.

FIG. 3 is a view for schematically illustrating an overall configuration of the second processing portion B2 according to the first embodiment. As described above, the second processing portion B2 includes the folding processing device 41 configured to perform folding processing of folding a bundle of sheets, which is conveyed from the second sheet delivery path 31, collected, and aligned, and the binding processing unit 42 configured to perform binding processing on the bundle of sheets before being subjected to folding processing. The binding processing unit 42 is a stapler device configured to bind a bundle of sheets with staples. A stapleless binding device configured to perform binding processing on a bundle of sheets without use of staples may be used for the binding processing unit 38.

In order to convey sheets to the folding processing device 41, a sheet conveyance path 48 is connected to the second sheet delivery path 31. On the downstream side of the sheet conveyance path 48 in the conveyance direction of the sheets to be conveyed from the second sheet delivery path 31 to a sheet stacking tray 51, the sheet stacking tray 51 constructing a part of the sheet conveyance path 48 is disposed to position and stack the sheets to be subjected to the folding processing. On immediate upstream of the sheet stacking tray 51, there are disposed the binding processing unit 42 and a staple receiving portion 42*a* thereof at opposed positions across the sheet conveyance path 48.

On one side of the sheet stacking tray 51, a folding roller pair 52 serving as a rotary member pair is disposed so as to be opposed to one surface of a sheet or a bundle of sheets to be stacked on the sheet stacking tray 51. The folding roller pair 52 includes folding rollers 53 and 54 having roller surfaces (circumferential surfaces) 81 and 82 in press contact with each other, and is disposed so that a press-contact portion 55 thereof is oriented toward the sheet stacking tray 51. The folding rollers 53 and 54 are disposed next to each other, and on the upstream side and on the downstream side, respectively, along the carry-in direction of a sheet conveyed to the sheet stacking tray so as to be substantially equidistant from the sheet stacking tray 51. Further, in the present invention, the rotary member pair is not limited to the folding rollers 53 and 54 according to the embodiment, and may be constructed by a rotary belt or the like. Further, the folding roller pair 52 may be constructed so that a plurality of folding rollers (rotary members) are disposed serially along an axial direction of each of the folding rollers 53 and 54.

On a side opposite to the folding roller pair 52 across the sheet stacking tray 51, there is disposed a folding blade 56 serving as a thrusting member. The folding blade 56 has a tip end oriented toward the press-contact portion 55 of the folding roller pair 52 and is carried by a blade carrier 57. The blade carrier 57 is disposed so as to be runnable in a direction substantially perpendicularly transverse to the sheet stacking tray 51, that is, in a direction crossing the conveyance direction of a sheet conveyed from the second sheet delivery path 31 to the sheet stacking tray 51.

On both sides of the blade carrier 57 in the forward and backward directions in FIG. 3, that is, in the axial direction of the folding roller pair 52, there are disposed cam members 58 (only one cam member on the back side is illustrated in FIG. 3), which are constructed by a pair of eccentric cams mirror symmetrical to each other, at opposed positions. The cam member 58 is rotated by a drive unit such as a drive motor (not shown) about a rotary shaft 59 disposed at an eccentric position of the cam member 58. The cam member 58 has a cam groove 60 along an outer peripheral edge thereof.

The cam groove 60 has a cam profile including a first cam surface 60*a* having a maximum radius from the rotary shaft 59, and second cam surfaces 60*b* being disposed on both sides in a circumferential direction of the first cam surface 60*a* and each having a radius smaller than that of the first cam surface 60*a*. The blade carrier 57 includes a cam pin 61 (see FIG. 14A) serving as a cam follower to be slidably fitted into the cam groove 60.

When the cam member 58 is rotated by the drive motor, the blade carrier 57 runs so as to approach to or separate from the sheet stacking tray 51 by following the cam profile.

With this, as illustrated in FIG. 3, the folding blade 56 can be linearly moved in a freely advanceable and retreatable manner between an initial position, which is a position at which the tip end of the folding blade 56 does not enter the sheet conveyance path 48, and a maximum thrusting position at which the tip end of the folding blade 56 is nipped by the press-contact portion 55 of the folding roller pair 52, along a thrusting path P (FIG. 4) connecting the initial position and the maximum thrusting position.

At a lower end of the sheet stacking tray 51, there is disposed a regulating stopper 64 configured to allow a leading edge of a conveyed sheet to be in contact therewith to restrict the leading edge. The regulating stopper 64 is disposed so as to be raised and lowered along the sheet stacking tray 51 by a sheet raising and lowering mechanism 65.

The sheet raising and lowering mechanism 65 according to the embodiment is a conveyer belt mechanism which is constructed by a pair of pulleys 66 and 67 disposed on a back side of the sheet stacking tray 51 and in the vicinity of an upper end and a lower end along the sheet stacking tray, and a transmission belt 68 wrapping around both pulleys. The regulating stopper 64 is fixed on the transmission belt 68. The pulley 66 or the pulley 67 on the drive side is rotated by a drive unit such as a drive motor, to thereby cause the regulating stopper 64 to be raised and lowered between a lower end position illustrated in FIG. 3 and a desired height position. With this, a sheet or a bundle of sheets can be moved along the sheet stacking tray 51.

The folding processing device 41 further includes a sheet guide member 71 serving as a guide portion disposed between the sheet stacking tray 51 and the folding roller pair 52. In the folding processing device 41 illustrated in FIG. 4, the sheet guide member 71 is disposed on the side of the downstream folding roller 54. The sheet guide member 71 may be constructed by a plate-like member extending along the axial direction of the folding roller 54. The sheet guide member 71 includes a base end portion disposed downstream of the folding roller 54 in the conveyance direction of a sheet conveyed from the second sheet delivery path 31 to the sheet stacking tray 51, and a tip end portion 73 serving as a contact portion which is located upstream of the base end portion 72 and brought into contact with the roller surface 82 of the folding roller 54. The tip end portion (contact portion) 73 which causes the sheet guide member 71 to be brought into contact with the folding roller 54 is integrally formed with the sheet guide member 71.

The base end portion 72 of the sheet guide member 71 is accommodated in a bracket 74 fixed on an outer side of the sheet stacking tray 51. The tip end portion 73 is axially supported so as to be swingable about a rotary shaft 72*a* of the base end portion 72 in directions of approaching to and separating from a rotary shaft center of the folding roller 54. The sheet guide member 71 is always urged against the folding roller 54 by a compression coil spring 75 interposed between the sheet guide member 71 and the bracket 74. With this, when the folding roller 54 is rotated, the tip end portion 73 of the sheet guide member 71 is always held in slide contact with the roller surface 82 of the folding roller 54. With this, as described later, the tip end portion 73 of the sheet guide member 71 is configured so as to be swingable in accordance with the rotatory position of the folding roller 54 while being held in contact with the roller surface 82 of the folding roller 54. Further, the sheet guide member 71 has a gently inclined surface 76 gradually reduced in gap with the sheet stacking tray 51 from the tip end portion 73 toward the base end portion 72, that is, downstream in the sheet conveyance direction. The sheet guide member 71 is disposed so as to cover a part of the roller surface (circumferential surface) 82 of the folding roller 54, which is closest to the sheet conveyance path 48.

The tip end portion 73 of the sheet guide member 71 is disposed so as to come into contact with the roller surface 82 of the folding roller 54 at a position substantially corresponding to the rotary shaft center 84*a* of the folding roller 54 or a position beyond that position as viewed from downstream to upstream along the sheet conveyance direction. With this, the sheet guide member 71 is disposed so as to cover, downstream from the tip end portion 73, that is, the side opposite to the press-contact portion 55, a part of the roller surface 82 of the folding roller 54 on the side of the sheet stacking tray 51. In other words, the sheet guide member 71 is disposed so as to cover the roller surface 82 of the folding roller 54 at a part oriented toward the sheet stacking tray 51 excluding the press-contact portion 55 and the vicinity thereof in the folding roller pair 52.

With the sheet guide member 71, the gently inclined surface 76 serving as a guide surface gradually reduced in gap with the sheet stacking tray 51 toward the downstream is formed between the tip end portion 73 and the base end portion 72 of the sheet guide member 71. The inclined surface 76 is swung about the rotary shaft 72*a* integrally with the tip end portion 73 (contact portion) held in contact with the folding roller 54. For example, the sheet guide member 71 is formed of a plate member made of metal or rigid plastic. Thus, a friction coefficient of the inclined surface 76 is significantly smaller than that of at least the folding roller 54 made of a material having a large friction coefficient such as a rubber material.

Figure 5:
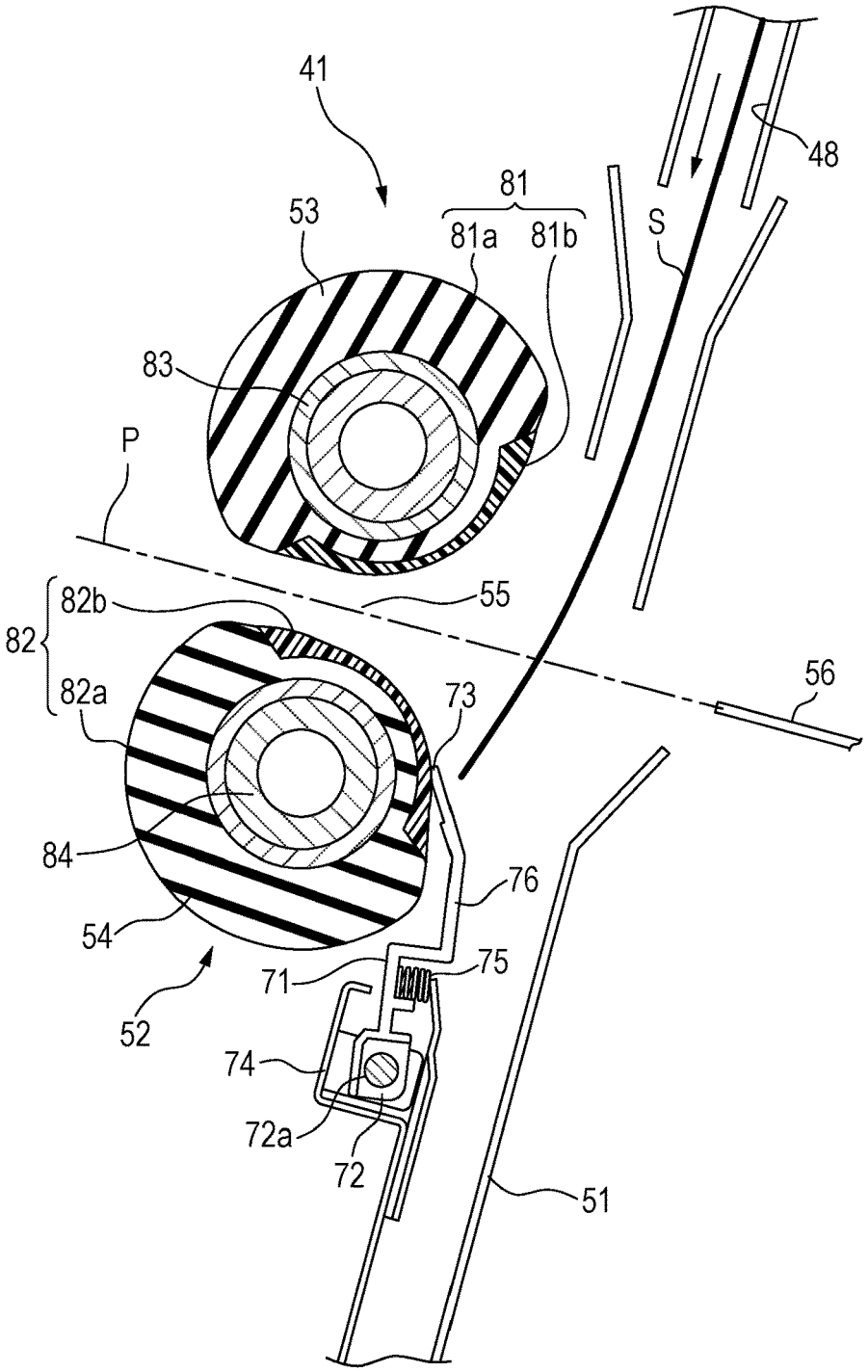
FIG. 5 is an explanatory view for illustrating a positional relationship between a folding roller pair and a sheet guide member at the time of conveyance of a sheet.

The tip end portion 73 is held in contact with the roller surface 82 of the folding roller 54. Thus, as illustrated in FIG. 5, a leading edge of a sheet S conveyed to the sheet stacking tray 51 is more securely returned to the sheet stacking tray 51 by the tip end portion 73 and the inclined surface 76. Thus, even when the leading edge of the sheet S is curled, the sheet S is prevented from deviating from the sheet stacking tray 51 toward the folding roller pair 52 on the course and being caught by the roller surfaces (circumferential surfaces) 81 and 82 of the folding roller pair 52, or is prevented from being nipped in a gap with the tip end portion 73 of the sheet guide member 71. Thus, jamming of the sheet S conveyed to the folding processing device 41 can be effectively prevented.

Further, when a bundle of sheets is conveyed in the sheet conveyance path 48 from the sheet stacking tray 51 toward the upstream for binding processing, and when the bundle of sheets is conveyed toward the downstream for folding processing after the binding processing, a concern in that a sheet on the side closest to the folding roller pair 52 is brought into contact with a surface of the folding roller 54 to cause deviation between the sheet and an inner sheet than the sheet may be eliminated. With this, formation of a fold line on a sheet surface due to the deviation between sheets of the bundle of sheets, and removal of some sheets from the bound portion can be prevented.

Figure 6:
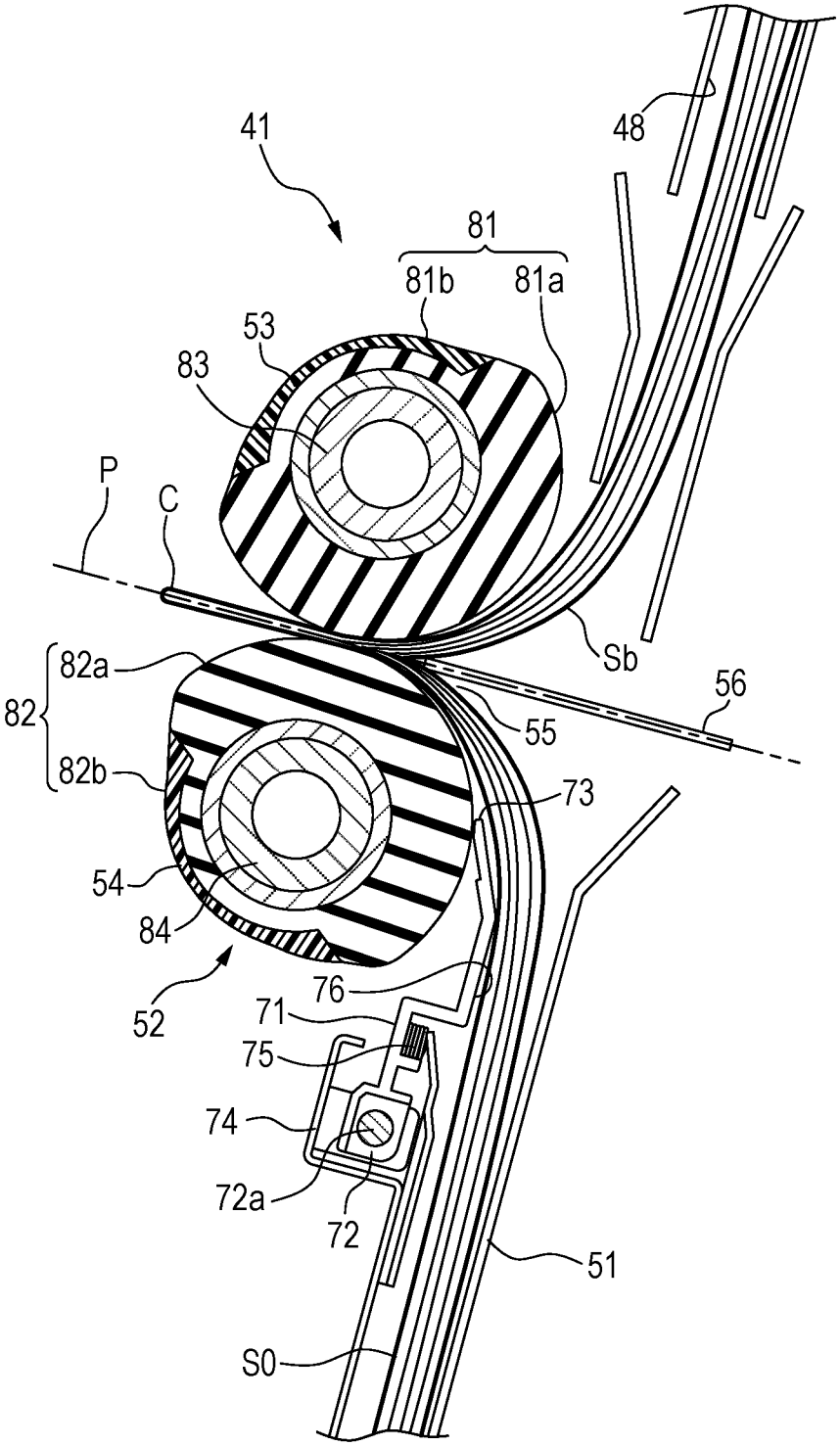
FIG. 6 is an explanatory view for illustrating a positional relationship between the folding roller pair and the sheet guide member at the time of folding processing.

FIG. 6 is an illustration of a state in which, as described later, a bundle of sheets Sb in the sheet stacking tray 51 is folded in half by the folding blade 56 and thrusted into the press-contact portion 55 of the folding roller pair 52. At this time, a sheet S0 on the outermost side of the bundle of sheets Sb, that is, on the side of the folding roller pair 52 is guided by the inclined surface 76 of the sheet guide member 71 and delivered into the press-contact portion 55. As described above, the inclined surface 76 has a small friction coefficient, and hence the sheet S0 moves smoothly while being held in slide contact with the inclined surface 76. Thus, concerns in deviation between the sheet S0 and an inner sheet, and folding processing with deviated sheets are eliminated.

Figure 4:
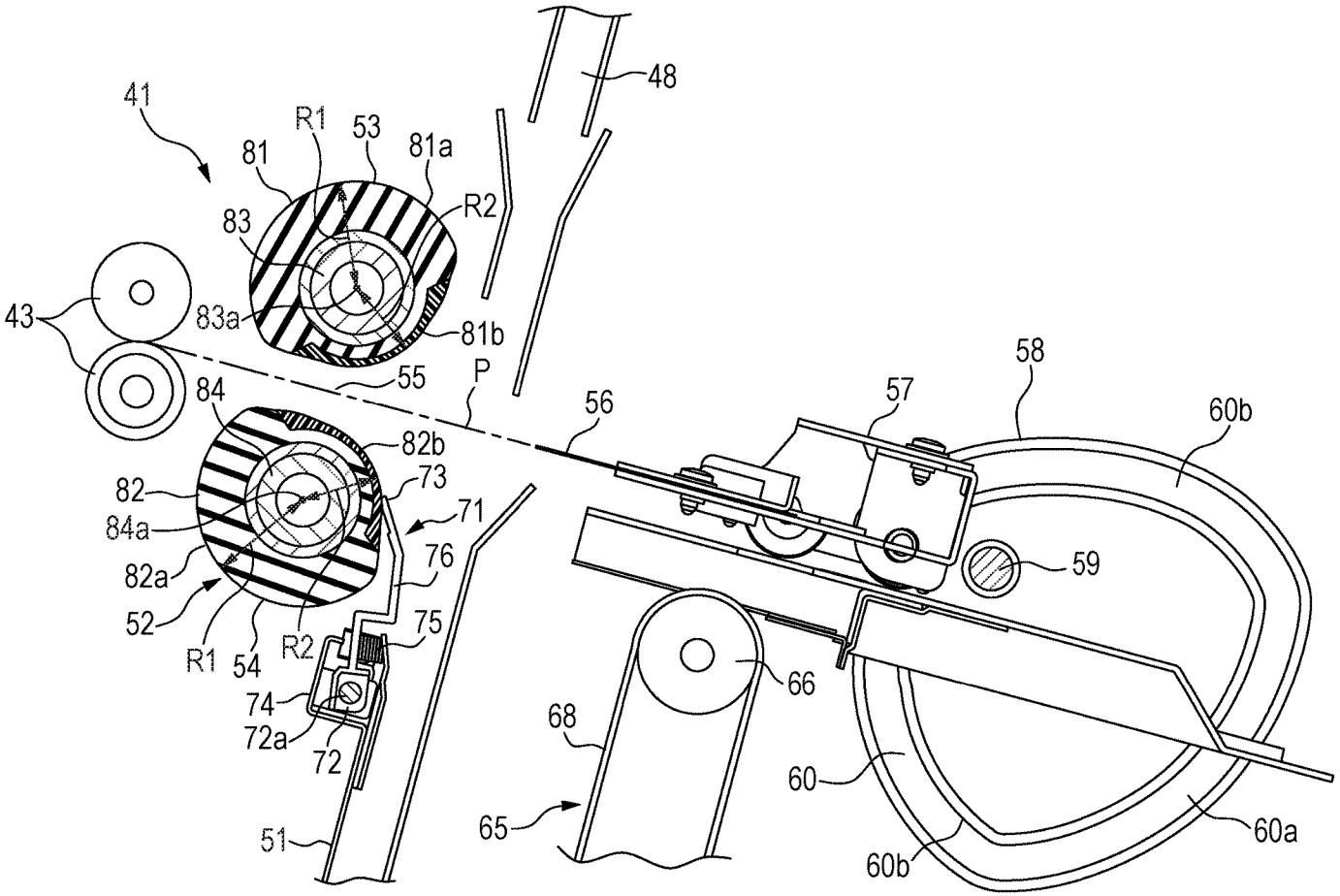
FIG. 4 is an enlarged sectional view for illustrating relevant parts of the folding processing device of FIG. 3.

In the folding rollers 53 and 54 of the folding roller pair 52, as illustrated in FIG. 4, the roller surfaces 81 and 82 include first roller surfaces (first circumferential surface parts) 81*a* and 82*a* of which a radius (first distance) R1 about rotary shaft centers 83*a* and 84*a* of the rotary shafts 83 and 84 is constant, and second roller surfaces (second circumferential surface parts) 81*b* and 82*b* in which a distance from the rotary shaft centers 83*a* and 84*a* of the rotary shafts 83 and 84 is a radius (second distance) R2 which is smaller than the radius R1 of the first roller surfaces, respectively. The radius (first distance) R1 between the first roller surfaces (first circumferential surface parts) 81*a* and 82*a* and the rotary shaft centers 83*a* and 84*a* of the rotary shafts 83 and 84 is greater than the radius (second distance) R2 between the second roller surfaces (second circumferential surface parts) 81*b* and 82*b* and the rotary shaft centers 83*a* and 84*a* of the rotary shafts 83 and 84. The first roller surfaces 81*a* and 82*a* are formed of a rubber material or the like having a relatively high friction coefficient as in a typical roller surface. In contrast, the second roller surfaces 81*b* and 82*b* are formed of a plastic resin material or the like having a friction coefficient smaller than that of the first roller surfaces 81*a* and 82*a*.

The rotary shafts 83 and 84 of the folding rollers 53 and 54 are driven to rotate by a common drive unit such as a drive motor. With this, rotation positions of the first roller surfaces 81*a* and 82*a* and the second roller surfaces 81*b* and 82*b* can always be synchronized. The rotary shafts 83 and 84 can be driven by a drive motor in common with the cam member 58.

At an initial position (first rotation position) before starting the folding processing, as illustrated in FIG. 4, the second roller surfaces 81*b* and 82*b* are set so as to be oriented toward the sheet conveyance path 48 at positions symmetrical with respect to the thrusting path P of the folding blade 56. The tip end portion 73 of the sheet guide member 71 is urged by the compression coil spring 75 as described above, and hence the tip end portion 73 is similarly brought into slide contact with both the first roller surface 82*a* and the second roller surface 82*b* regardless of the rotation position of the folding roller 54. Specifically, the sheet guide member 71 serving as a guide portion for a sheet is configured so as to move in conformity with the rotation position of the folding roller serving as the rotary portion while being held in contact with the first roller surface 82*a* and the second roller surface 82*b* which are circumferential surfaces of the folding roller 54. As illustrated in FIG. 5, when the sheet S is conveyed in the sheet conveyance path 48, while the second roller surfaces 81*b* and 82*b* are positioned at initial positions (first rotation positions), the sheet guide member 71 is positioned at a first position at which the tip end portion 73 of the sheet guide member 71 is held in contact with the second roller surfaces 81*b* and 82*b*. As illustrated in FIG. 6, while the second roller surfaces 81*b* and 82*b* are positioned at second rotation positions which are different from the initial positions (first rotation positions), the sheet guide member 71 is positioned at a second position at which the tip end portion 73 of the sheet guide member 71 is held in contact with the first roller surfaces 81*a* and 82*a*. At the second rotation positions, the first roller surfaces 81*a* and 82*a* are set so as to be oriented toward the sheet conveyance path 48. The tip end portion 73 of the sheet guide member 71 positioned at the second position is different in distance from the rotary shaft center 84*a* from the time of being positioned at the first position. A distance between the tip end portion 73 of the sheet guide member 71 positioned at the second position and the rotary shaft center 84*a* is larger than a distance between the tip end portion 73 of the sheet guide member 71 positioned at the first position and the rotary shaft center 84*a*. The first position is positioned closer to the rotary shaft center 84*a* (center side) of the folding roller 54 than the second position is.

Figure 7:
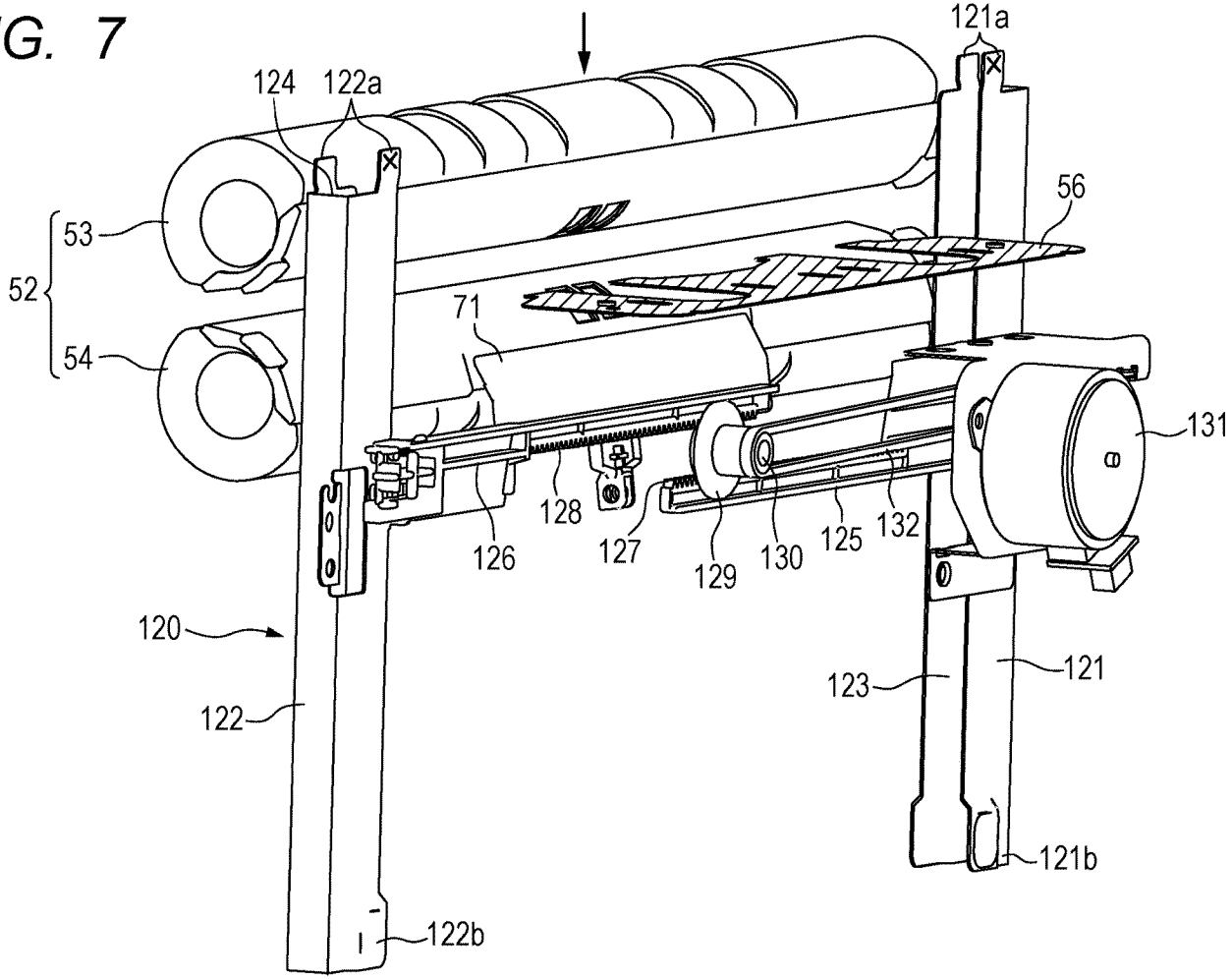
FIG. 7 is a perspective view for illustrating relevant parts of the folding processing device as viewed from a folding blade side.

The folding processing device 41 according to the embodiment further includes a sheet side edge alignment mechanism 120 configured to align side edges of sheets conveyed to the sheet stacking tray 51. As illustrated in FIG. 7, the sheet side edge alignment mechanism 120 serving as an alignment unit includes a pair of sheet side edge alignment members 121 and 122 which are spaced apart and disposed symmetrically in a direction orthogonal to a sheet conveyance direction indicated by the arrow in FIG. 7. The sheet side edge alignment members 121 and 122 have upper ends 121*a* and 122*a* and lower ends 121*b* and 122*b* held so as to be movable by a guide portion (not shown) fixed on the apparatus housing 27, to thereby approach to and separate from each other in the direction orthogonal to the sheet conveyance direction.

The sheet side edge alignment members 121 and 122 are each formed of a frame member having a substantially square bracket shape section extending along the sheet carry-in direction, and are disposed parallel to each other with opening portions of the substantially square bracket shapes opposed to each other. Inner surfaces of the substantially square bracket shape of the sheet side edge alignment members 121 and 122 define sheet side edge regulating surfaces 123 and 124 (FIG. 8A) configured to align side edges of the sheets in the sheet stacking tray 51 in a direction orthogonal to (crossing with) the sheet conveyance direction (conveyance direction), that is, a width direction of the sheets. In particular, the sheet side edge regulating surfaces 123 and 124 each having the substantially square bracket shape section can regulate the side edges of the sheets in the sheet stacking tray 51 not only in the sheet width direction but also in a thickness direction of the sheets, that is, a thickness direction of the sheet stacking tray 51 (sheet conveyance path 48).

At respective outer surfaces of the sheet side edge alignment members 121 and 122 on the side of the folding blade 56 near a center in the longitudinal direction, there are integrally fixed guide rail members 125 and 126 linearly extending toward other sheet side edge alignment members 121 and 122, respectively. The guide rail members 125 and 126 are disposed parallel in the vertical direction of FIG. 7 with a predetermined gap in the sheet conveyance direction so that at least respective distal end sides thereof partially overlap with each other.

On the lateral sides of the guide rail members 125 and 126 opposed to each other in the vertical direction, there are disposed racks 127 and 128 formed such that, when the sheet side edge alignment members 121 and 122 approach to and separate from each other, a predetermined gap is held in the sheet conveyance direction. Both the racks 127 and 128 concurrently engage with a common pinion 129 axially supported on the apparatus housing 27 in a rotatable manner.

On the pinion 129, there is mounted a driven side pulley 130 coaxially with the pinion 129 and on the side of the folding blade 56 so as to be integrally rotatable. A transmission belt 132 wraps around the pulley 130 so that power can be transmitted with respect to a pulley on a driving side (not shown) connected to an output shaft of a sheet side edge alignment motor 131 fixed on the apparatus housing 27.

Thus, the sheet side edge alignment members 121 and 122 are moved by equal distance in synchronization so as to approach to or separate from each other in the width direction of the sheets through rotation of the pinion 129 by driving the motor 131. With this, when a position of a sheet in the sheet stacking tray 51 is deviated in the sheet width direction, the sheet side edge regulating surface 123 or 124 can be brought into contact with the side edge of the sheet to move the sheet to a desired alignment position.

Figure 8A:
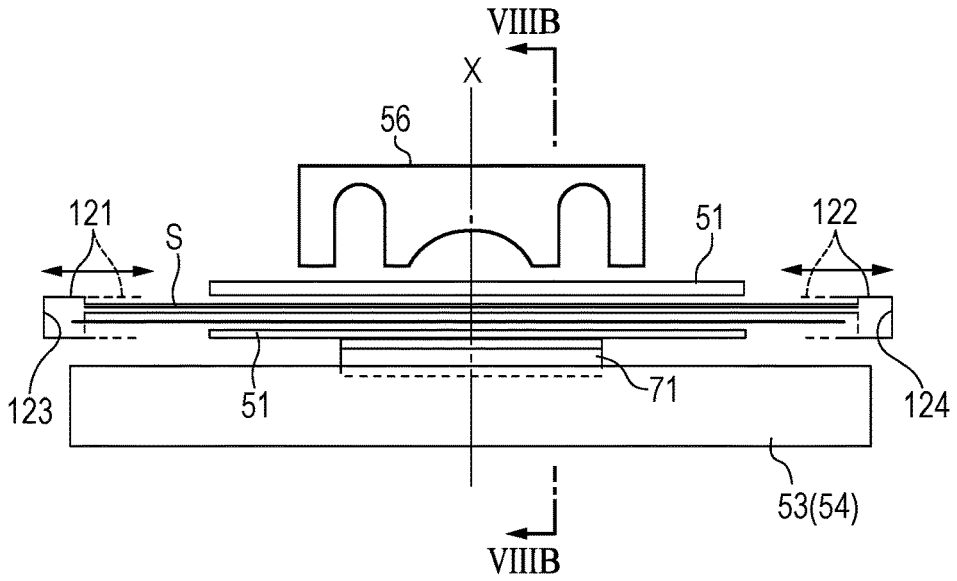
FIG. 8A is a schematic view for illustrating relevant parts of the folding processing device of FIG. 7 as viewed from above, that is, from the sheet carry-in side.
Figure 8B:
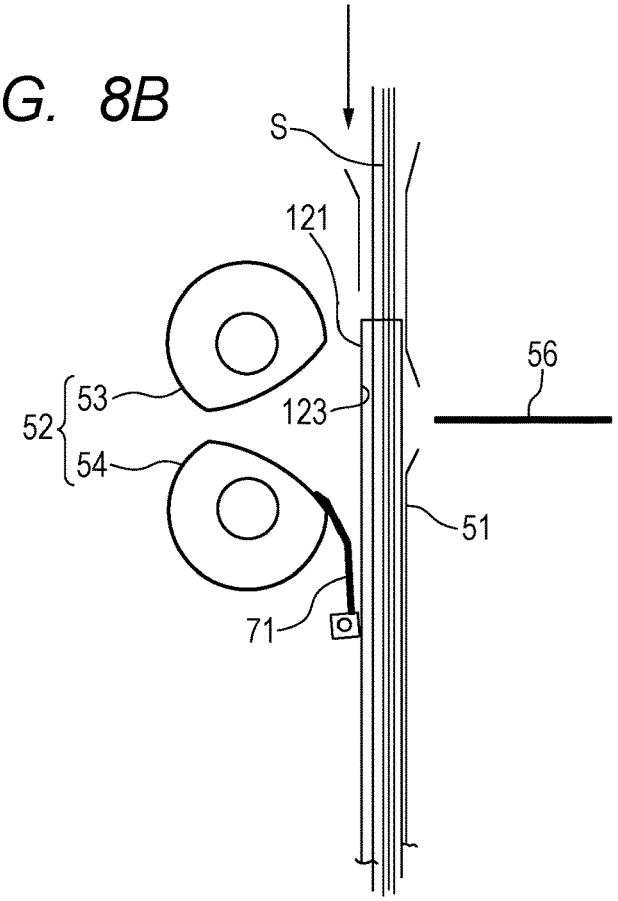
FIG. 8B is a sectional view taken along the line VIIIB-VIIIB of FIG. 8A.

In the embodiment, a center position of the sheet stacking tray 51 (a center position of the folding roller pair 52 and the folding blade 56) in the sheet width direction is set at a center reference position X for the folding processing as illustrated in FIG. 8A. The sheet side edge alignment members 121 and 122 are disposed at the initial positions indicated by the solid lines in FIG. 8A, which are set equidistant from the center reference position X in the sheet width direction in the initial state.

Through rotation of the motor 131, the sheet side edge alignment members 121 and 122 are moved from the initial positions by a predetermined equal distance in accordance with the width dimension of the sheet in the sheet stacking tray 51 as indicated by the broken lines in FIG. 8A, to thereby allow a widthwise center position of the sheet to be aligned so as to match with the center reference position X. After the side edges of the sheet are aligned, the sheet side edge alignment members 121 and 122 are returned to the initial positions through reverse rotation of the motor 131.

In a case where a plurality of sheets are to be conveyed to the sheet stacking tray 51, the widthwise position of the first sheet is aligned as described above, and the sheet side edge alignment members 121 and 122 are returned to the initial positions, and thereafter the next sheet is conveyed. The above-mentioned widthwise alignment operation for the sheet performed by the sheet side edge alignment members 121 and 122 is repeatedly performed with respect to the next sheet, to thereby allow the first sheet and the next sheet to be aligned at the side edges and superposed on one after another. The widthwise alignment operation for the sheet is repeated each time a sheet is newly conveyed, thereby being capable of aligning the plurality of sheets at predetermined widthwise positions in the sheet stacking tray 51 and collecting the sheets.

In a case where the width dimension of the sheets to be subjected to folding processing is small, it is preferred that the sheet side edge alignment members 121 and 122 be moved in advance closer to the center from the outermost positions in the sheet width direction indicated by the solid lines in FIG. 8A in conformity with the width dimension. With this, even when the sheets are deviated to some extent in the width direction during conveyance to the sheet stacking tray 51, both side edges thereof are definitely placed within the substantially square bracket shape sections of the respective sheet side edge alignment members 121 and 122, thereby being capable of similarly aligning the sheets at the predetermined widthwise positions in the sheet stacking tray 51.

The movement of the sheet side edge alignment members 121 and 122, the amount of the movement, and the direction of the movement are controlled by controlling the activation and rotation of the motor 131 through a processing apparatus controller disposed in the sheet processing apparatus B. Further, the dimension of the sheets to be subjected to the folding processing is transmitted in advance, together with other information related to the folding processing, from the image forming apparatus A to the processing apparatus controller of the sheet processing apparatus B.

As described above, in the embodiment, the side edges of the sheets in the sheet stacking tray 51 are guided by the substantially square-bracket-shaped sheet side edge regulating surfaces 123 and 124 of the sheet side edge alignment members 121 and 122 while being regulated in the width direction and the thickness direction of the sheets. Thus, there is no need to arrange the sheet guide member 71 over an entire length of the folding rollers 53 and 54 along the sheet width direction, that is, a lateral direction crossing a sheet length direction which is the conveyance direction of the sheets to be conveyed to the sheet stacking tray 51 from the second sheet delivery path 31. That is, it is only necessary that the sheet guide member 71 guide at least the vicinity of the widthwise center of the sheets as illustrated in FIG. 7 and FIG. 8A. In other words, it is only necessary that the sheet guide member 71 be disposed at a position between the sheet side edge alignment members 121 and 122 in the sheet width direction. With this, the sheets can be conveyed smoothly without causing jamming in cooperation with the sheet side edge alignment members 121 and 122. The sheet guide member 71 may be disposed so as to extend over substantially the entire length of the folding roller 54 along the axial direction of the folding roller 54.

Therefore, there is no need to arrange the sheet guide member 71 over the entire length of the folding rollers 53 and 54 along the sheet width direction, and hence the size of the sheet guide member 71 can be reduced in the sheet width direction. Further, the sheet guide member 71 can be positioned highly accurately with respect to the folding roller 54 through contact with the folding roller 54. With this, the folding roller pair 52 can be disposed closer to the sheet stacking tray 51 to reduce a gap with respect to the sheet stacking tray 51. Consequently, an overall size of the folding processing device 41 is reduced, thereby being capable of saving space for the sheet processing apparatus B.

Figure 9:
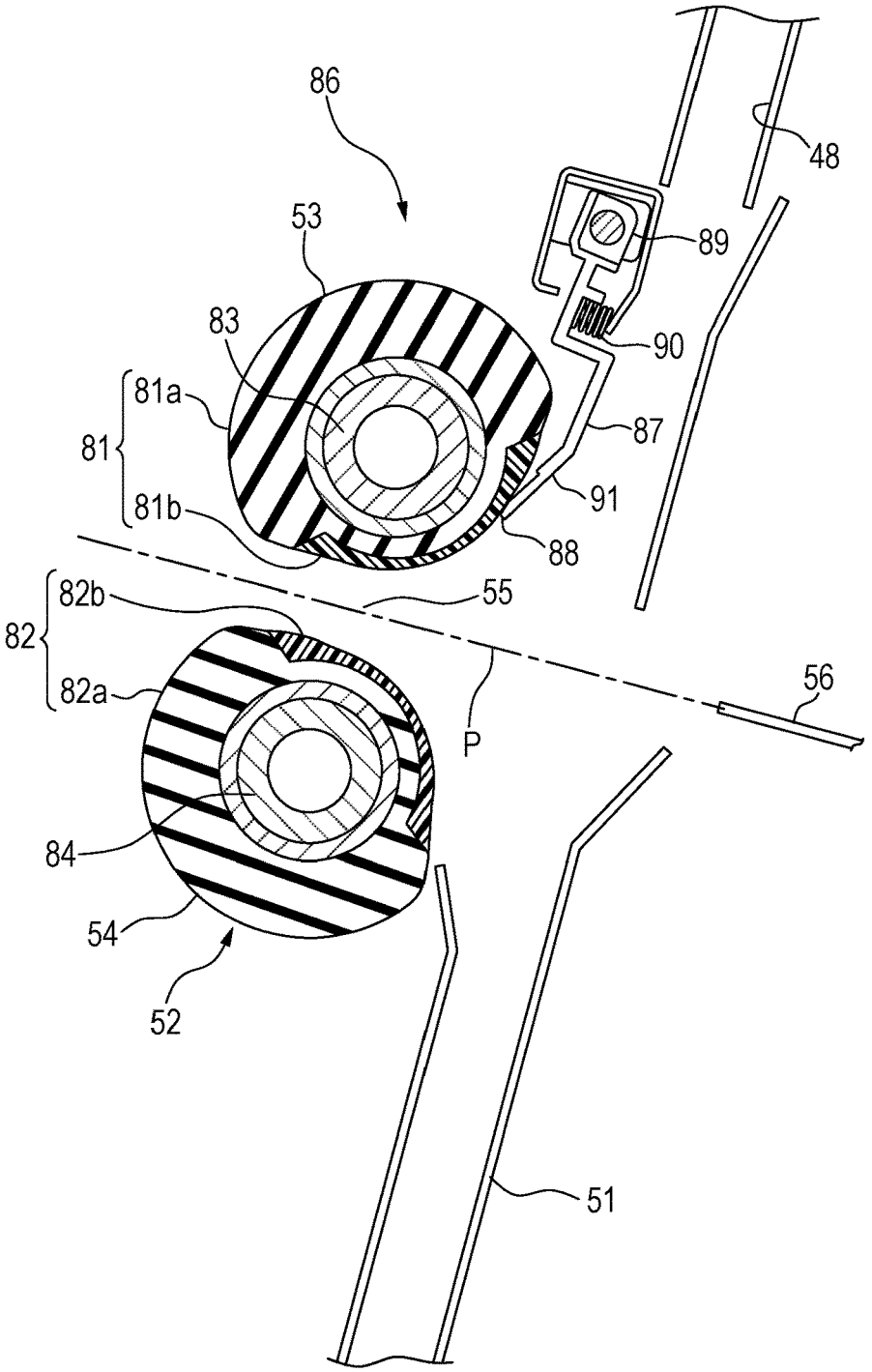
FIG. 9 is an explanatory view for illustrating a folding processing device according to another embodiment of the present invention.

FIG. 9 is an illustration of a folding processing device 86 according to another embodiment of the present invention. The folding processing device 86 is different from the folding processing device 41 according to the embodiment illustrated in FIG. 1 to FIG. 8B in that a sheet guide member 87 in place of the sheet guide member 71 is disposed on the side of the folding roller 53 upstream in the sheet conveyance direction. In FIG. 9, the components which are the same as those of FIG. 1 to FIG. 8B are denoted by the same reference symbols, and hence detailed description thereof is omitted as described above.

Similarly to the sheet guide member 71, in the sheet guide member 87, a tip end portion 88 serving as a contact portion is held in contact with the roller surface of the folding roller 53 upstream in the sheet conveyance direction, and a base end portion 89 is axially supported in a swingable manner upstream of the folding roller 53 in the sheet conveyance direction and is always urged against the folding roller 53 with a compression coil spring 90 so that the tip end portion 88 is always held in slide contact with the roller surface 81. Further, in the sheet guide member 87, there is formed a gently inclined surface 91 which is gradually reduced in gap with the sheet stacking tray 51 from the tip end portion 88 toward the base end portion 89, that is, upstream in the sheet conveyance direction.

As described above, the sheet guide member 87 is disposed so as to cover, upstream of the tip end portion 88, a part of the folding roller 53 on the side of the sheet stacking tray 51. With this, when a sheet is conveyed from the sheet conveyance path 48 to the sheet stacking tray 51, and a leading edge of the sheet deviates toward the folding roller pair 52, the sheet is securely returned to the sheet stacking tray 51 without being obstructed by the roller surfaces (circumferential surfaces) 81 and 82 of the folding roller pair 52. Thus, jamming of the sheets to be conveyed to the folding processing device 86 can be effectively prevented.

Further, when a bundle of sheets stacked on the sheet stacking tray 51 is conveyed for binding processing toward upstream in the sheet conveyance direction, and when the bundle of sheets is conveyed for the folding processing toward downstream after the binding processing, a concern in that a sheet on the side closest to the folding roller 53 is brought into contact with the roller surface 81 of the folding roller 53 to cause deviation with an inner sheet may be eliminated. With this, formation of a fold line on a sheet surface due to the deviation between the sheets, or removal of some sheets from the bound portion can be prevented.

Figure 10:
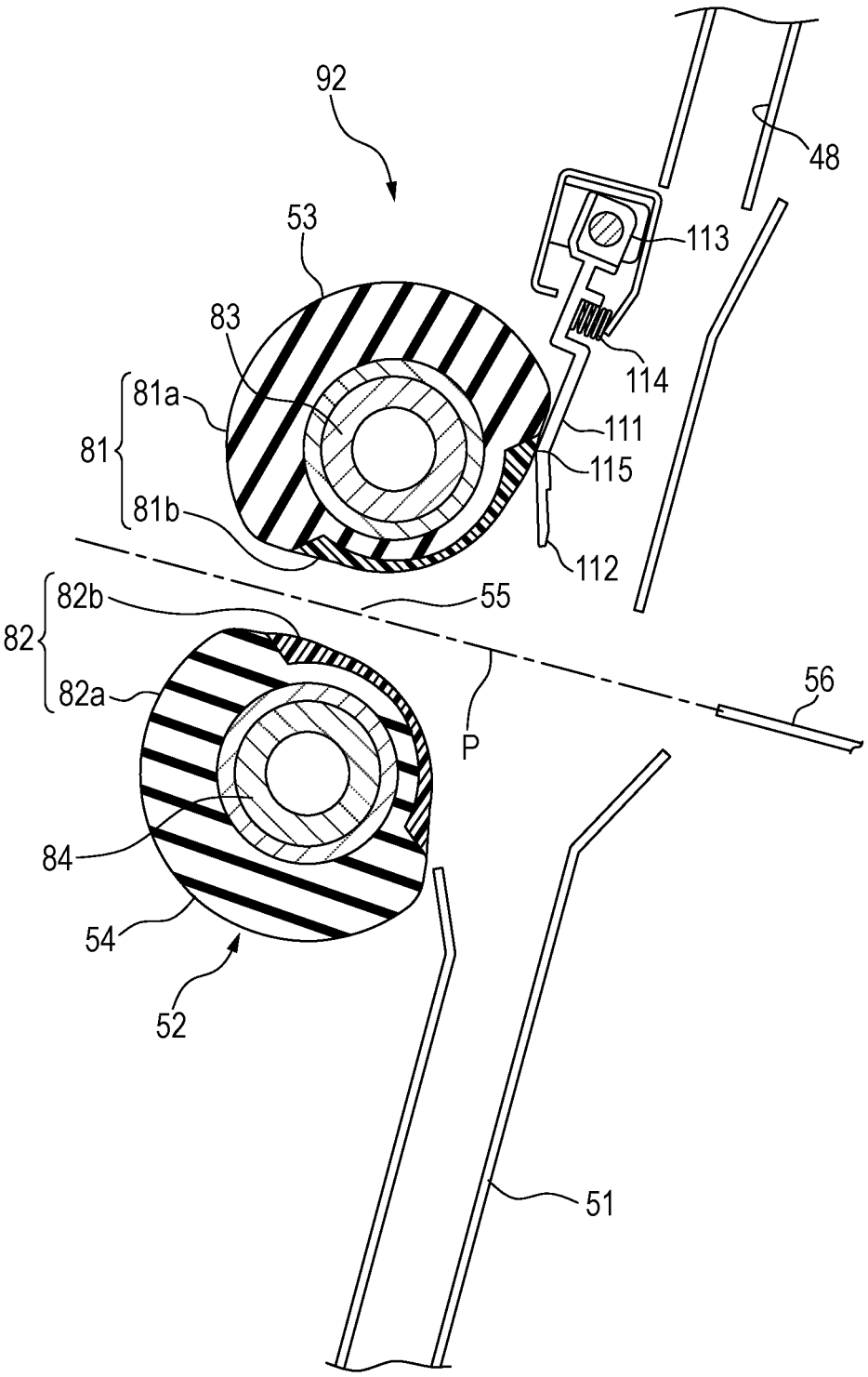
FIG. 10 is an explanatory view for illustrating a modified example of the folding processing device of FIG. 9.

FIG. 10 is an illustration of a folding processing device 92 according to a modified example of the embodiment of FIG. 9. The folding processing device 92 is different from the folding processing device 86 of FIG. 9 in that a sheet guide member 111 is bent at an intermediate portion 115 so that a tip end portion 112 thereof is oriented toward the sheet stacking tray 51 rather than the folding roller 53. In FIG. 10, the components which are the same as those of FIG. 9 are denoted by the same reference symbols.

The sheet guide member 111 is axially supported in a swingable manner at a base end portion 113 and always urged against the folding roller 53 with a compression coil spring 114. With this, the sheet guide member 111 is always held in slide contact with the roller surface 81 of the folding roller 53 at the intermediate portion 115 serving as a contact portion, and the tip end portion 112 more securely keeps a sheet away from the folding roller pair 52 toward the sheet stacking tray 51, thereby preventing the sheet from being caught by the folding roller pair 52. The operation of the sheet guide member 111 is the same as that of the sheet guide member 87, and hence description thereof is omitted.

Figure 11:
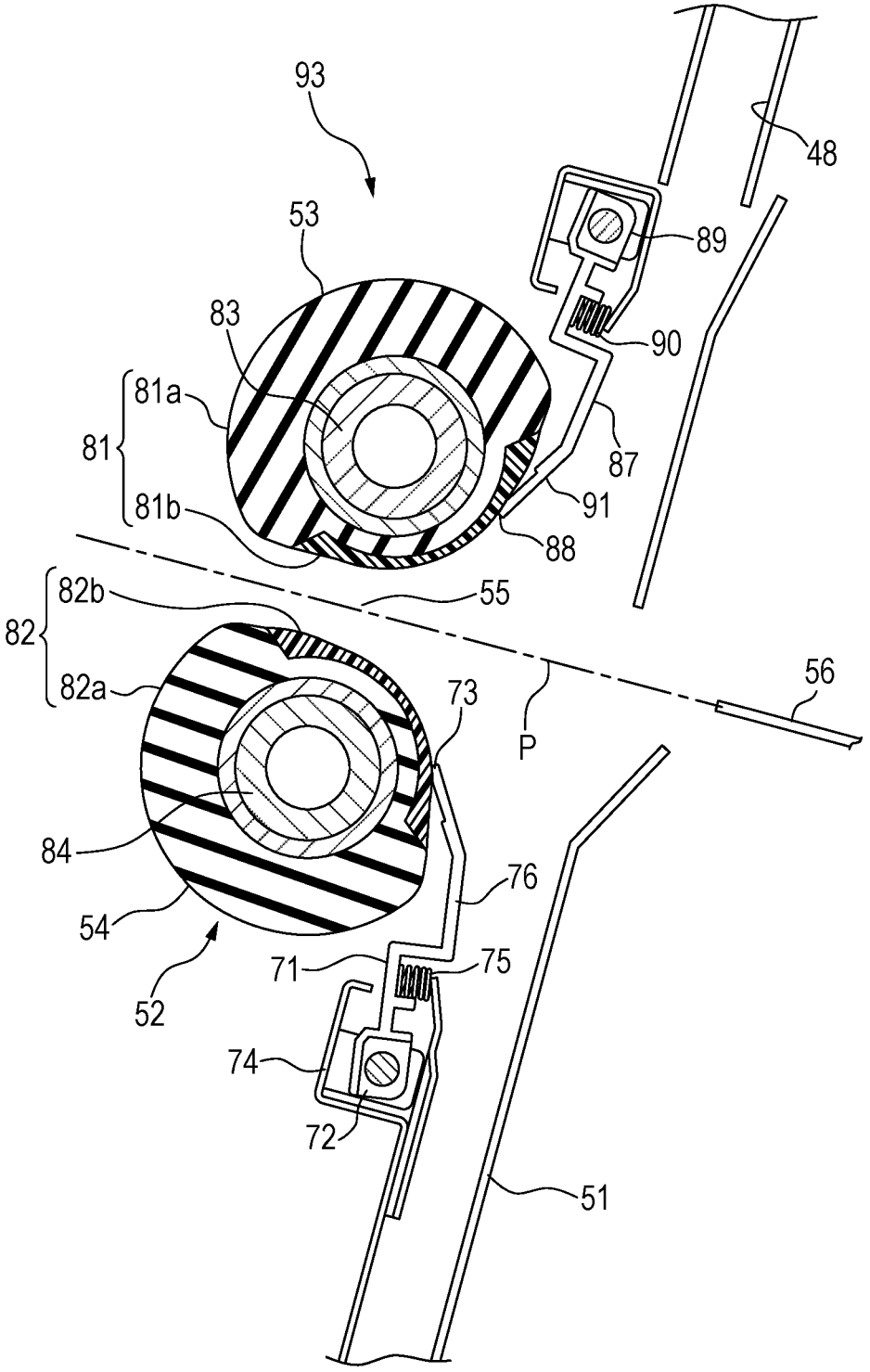
FIG. 11 is an explanatory view for illustrating a folding processing device according to yet another embodiment of the present invention.

FIG. 11 is an illustration of a folding processing device 93 according to yet another embodiment of the present invention. In the folding processing device 93, the sheet guide members 71 and 87 are disposed on both the folding rollers 53 and 54, respectively. In FIG. 11, components which are the same as those of FIG. 1 to FIG. 9 are denoted by the same reference symbols. According to the embodiment, jamming of a sheet during conveyance of the sheet and deviation of sheets during conveyance of a bundle of sheets can be prevented more securely as compared to the embodiments described above.

Figure 12:
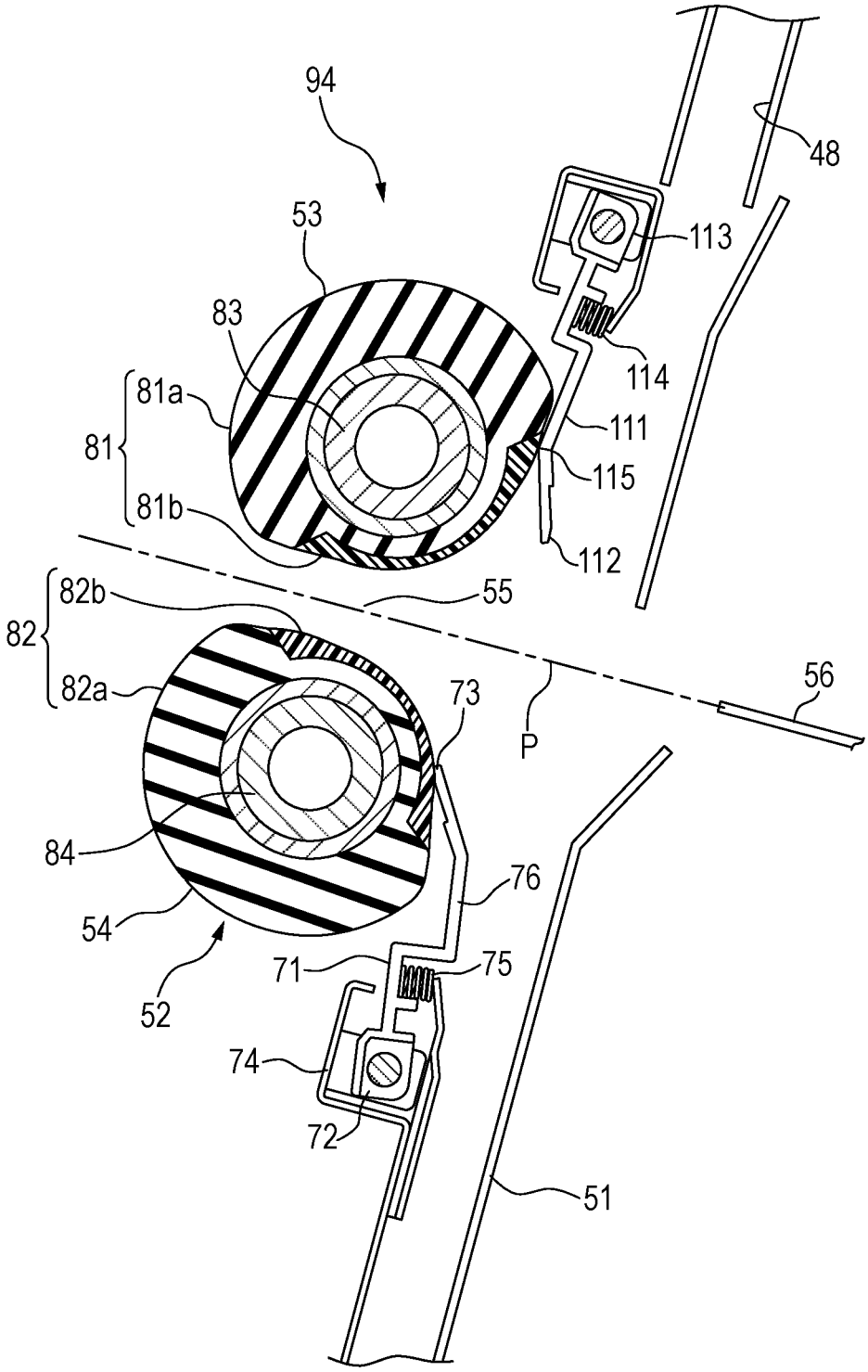
FIG. 12 is an explanatory view for illustrating a modified example of the folding processing device of FIG. 11.

FIG. 12 is an illustration of a folding processing device 94 according to a modified example of the embodiment of FIG. 11. The folding processing device 94 is different from the folding processing device 93 of FIG. 11 in that the sheet guide member 111 of FIG. 11 is disposed on the upstream folding roller 53. In FIG. 12, components which are the same as those of FIG. 1 to FIG. 8B, FIG. 10, and FIG. 11 are denoted by the same reference symbols. Also in the modified example, similarly to the folding processing device 93 of FIG. 11, jamming of a sheet during conveyance of the sheet, and deviation of sheets during conveyance of a bundle of sheets can be prevented more securely.

Figure 13:
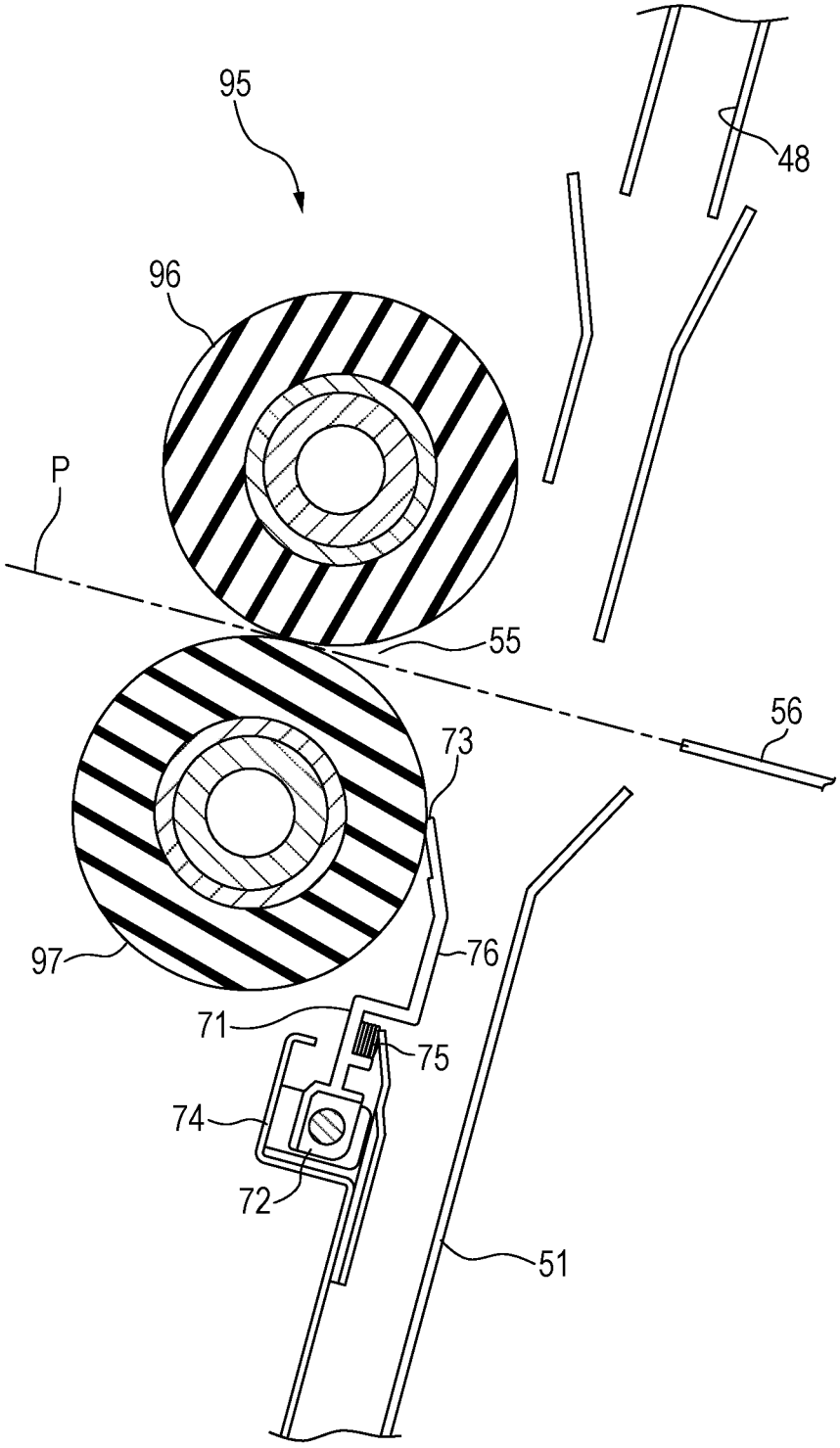
FIG. 13 is an explanatory view for illustrating a folding processing device according to yet another embodiment of the present invention.

FIG. 13 is an illustration of a folding processing device 95 according to yet another embodiment of the present invention. In the folding processing device 95, both folding rollers 96 and 97 have roller surfaces each having a constant radius over an entire circumference. Also in FIG. 13, components which are the same as those of FIG. 1 to FIG. 8B are denoted by the same reference symbols. The present invention is similarly applicable to such a folding processing device 95 including the pair of folding rollers 96 and 97 constructed by normal folding rollers, and excellent function and effect can be similarly obtained.

The folding processing devices according to the embodiments described above are configured to subject a bundle of sheets to the folding processing by folding a bundle of sheets on the sheet stacking tray 51 with the folding blade 56 while thrusting the bundle of sheets into the press-contact portion 55 of the folding roller pair 52 (96 and 97). In another embodiment, a bundle of sheets can be similarly subjected to the folding processing by a well-known sheet thrusting portion in place of the folding blade 56.

As such a sheet thrusting portion, for example, there is a configuration including a folding roller pair and pull-in rollers disposed so as to be opposed to folding rollers of the folding roller pair, respectively. The sheet thrusting portion is configured to perform the folding processing by nipping a bundle of sheets at both sides of a folding position with the folding roller and the pull-in roller, rotating the folding roller and the pull-in roller to flex a center portion of the bundle of sheets toward the folding roller pair, and conveying the bundle of sheets into the press-contact portion of the folding roller pair.

Further, in yet another embodiment, the sheet stacking tray 51 can be replaced with a sheet conveyance path. In this case, the folding processing device 41 may be disposed, for example, downstream or upstream of the binding processing unit 42 on the course of the sheet conveyance path 48 connected to the second sheet delivery path 31. It is preferred that a stopper member in place of the regulating stopper 64 be disposed downstream of the folding processing device 41 along the sheet conveyance path 48 so as to position a leading edge of a bundle of sheets and align a folding position of the bundle of sheets to the thrusting path P.

The sheet conveyance path 48 may be connected to another post-processing unit or a sheet delivery tray downstream of the folding processing device 41. Further, similarly to the embodiments described above, a bundle of sheets having been subjected to the folding processing may be delivered to the stacking tray 44 by the delivery roller pair 43, or may be returned from the folding roller pair 52 to the sheet conveyance path 48 and conveyed to any direction.

Now, a series of operations in the second processing portion B2 of the sheet processing apparatus B according to the embodiment will be described. The series of operations include conveying a plurality of sheets to the sheet stacking tray 51, collecting the sheets, subjecting the sheets to the binding processing and the folding processing, and thereafter conveying the sheets to the stacking tray 44. The series of operations can be controlled by the processing apparatus controller disposed in the sheet processing apparatus B.

First, sheets having been subjected to image formation and conveyed from the image forming apparatus A are introduced one by one from the carry-in port 26 to the sheet processing apparatus B, conveyed from the sheet carry-in path 28 through the first sheet delivery path 30 and the second sheet delivery path 31, and conveyed from the sheet conveyance path 48 to the sheet stacking tray 51. The conveyed sheets are aligned one by one at the respective leading edges by the regulating stopper 64, or aligned in the width direction by the sheet side edge alignment mechanism 120 serving as the alignment unit, and collected in the sheet stacking tray 51.

After a predetermined number of sheets are collected to form a bundle of sheets, the sheet raising and lowering mechanism 65 is operated to raise the regulating stopper 64 to a height at which a binding position, for example, a center position of a bundle of sheet matches with a binding processing position of the processing unit 42. Next, the processing unit 42 is operated to bind the bundle of sheets with staples. The sheet raising and lowering mechanism 65 is operated again to lower the regulating stopper 64 to a height at which a bound portion, that is, a center position of the bundle of sheets matches with a folding processing position of the folding processing device 41, that is, the thrusting path P of the folding blade 56.

Figure 14A:
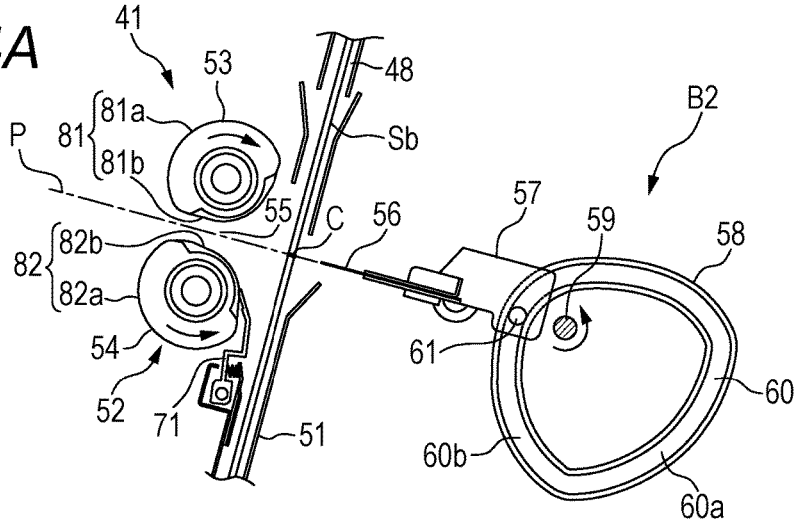
FIG. 14A, FIG. 14B, and FIG. 14C are schematic explanatory views for illustrating steps of the folding processing on a bundle of sheets.

Of the attached drawings, FIG. 14A, FIG. 14B, FIG. 14C, FIG. 15A, FIG. 15B, FIG. 16A, and FIG. 16B are illustrations of processes of allowing the bundle of sheets having been subjected to binding processing by the binding processing unit 42 to be subjected to the folding processing by the folding processing device 41. FIG. 14A is an illustration of an initial state immediately before starting the folding processing operation in which a bundle of sheets Sb is lowered to a height at which the bound portion thereof, that is, a center position C thereof matches with the thrusting path P of the folding blade 56.

From that state, the cam member 58 is rotated by a predetermined angle in a counter-clockwise direction in FIG. 14A, to thereby allow the folding blade 56 to advance to a maximum thrusting position, that is, a position of being nipped in the press-contact portion 55 of the folding roller pair 52. The folding roller pair 52 is rotated in synchronization with rotation of the cam member 58. That is, the folding roller pair 52 is rotated in a direction of conveying the bundle of sheets toward the delivery roller pair 43 concurrently with the rotation of the cam member 58. With this, the bundle of sheets Sb is nipped, at a leading edge portion thereof with the bound portion C as a top end, between the folding rollers 53 and 54 of the folding roller pair 52.

For a certain period of time after the bound portion C first reaches the press-contact portion 55, the bundle of sheets Sb is nipped, at a leading edge portion thereof, between the second roller surfaces 81*b* and 82*b* of the folding roller pair 52. The second roller surfaces 81*b* and 82*b* have a low friction coefficient, and a certain amount of gap is formed between the second roller surfaces 81*b* and 82*b*. Thus, the bundle of sheets nipped between the second roller surfaces 81*b* and 82*b* does not cause deviation between an outermost sheet and an inner sheet. After the folding roller pair 52 is rotated by a certain angle or more, and the bundle of sheets is conveyed by some distance in the conveyance direction, the bundle of sheets Sb is nipped with a greater force between the first roller surfaces 81*a* and 82*a* having a higher friction coefficient and a larger radius, as illustrated in FIG. 14B.

The cam member 58 is further rotated by a certain angle in the counter-clockwise direction, and the folding roller pair 52 is further rotated in conformity with the rotation of the cam member 58, to thereby further convey the bundle of sheets Sb by a certain distance in the conveyance direction. In contrast, as illustrated in FIG. 14C, the folding blade 56 remains stopped at the same position as in FIG. 14B because the cam pin 61 moves along the first cam surface 60*a* of the cam groove 60.

Figure 14B:
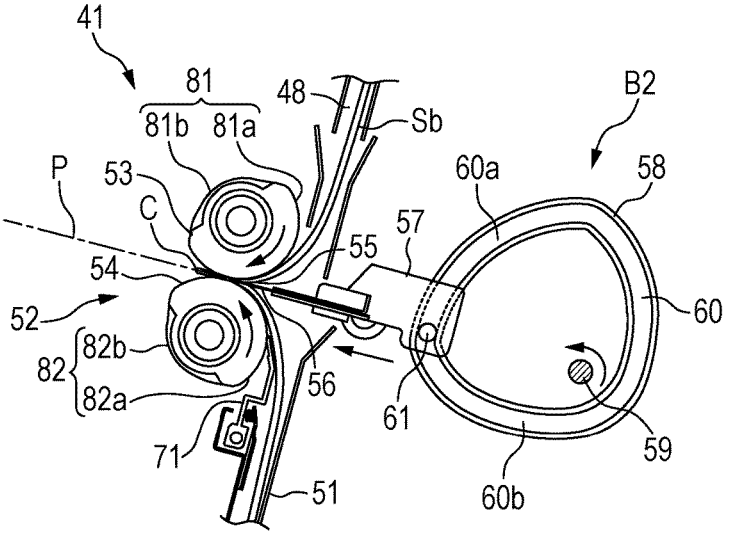
Figure 14C:
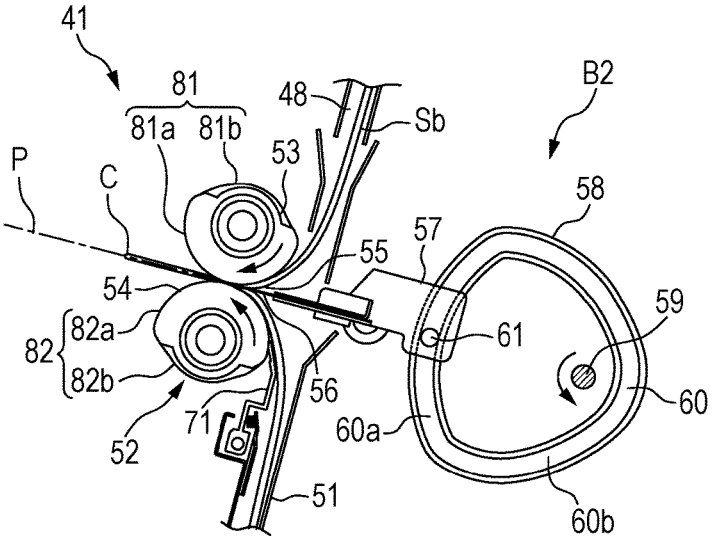
Figure 15A:
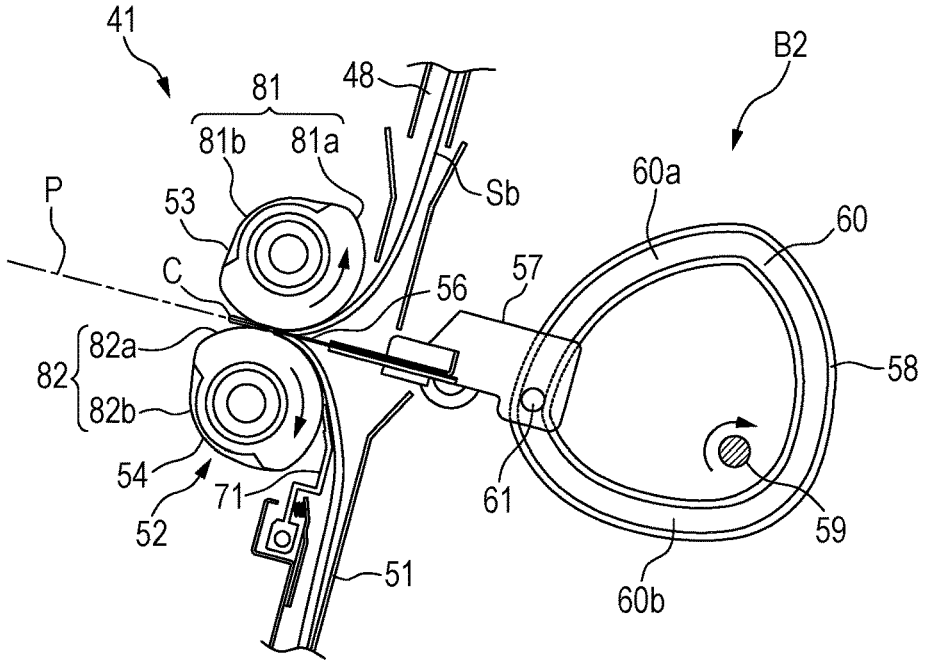
FIG. 15A and FIG. 15B are schematic explanatory views for illustrating steps of the folding processing on the bundle of sheets, which are subsequent to FIG. 14C.

Next, as illustrated in FIG. 15A, the cam member 58 is rotated in a reverse direction, that is, a clockwise direction, and returned to the same position as in FIG. 14B. At the same time, the folding roller pair 52 is reversely rotated to return the bundle of sheets Sb from the position of FIG. 14C to the position of FIG. 14B. In such a manner, first folding processing is performed with respect to the bundle of sheets Sb. At this time, the folding blade 56 is still stopped at the position of FIG. 14B.

Figure 15B:
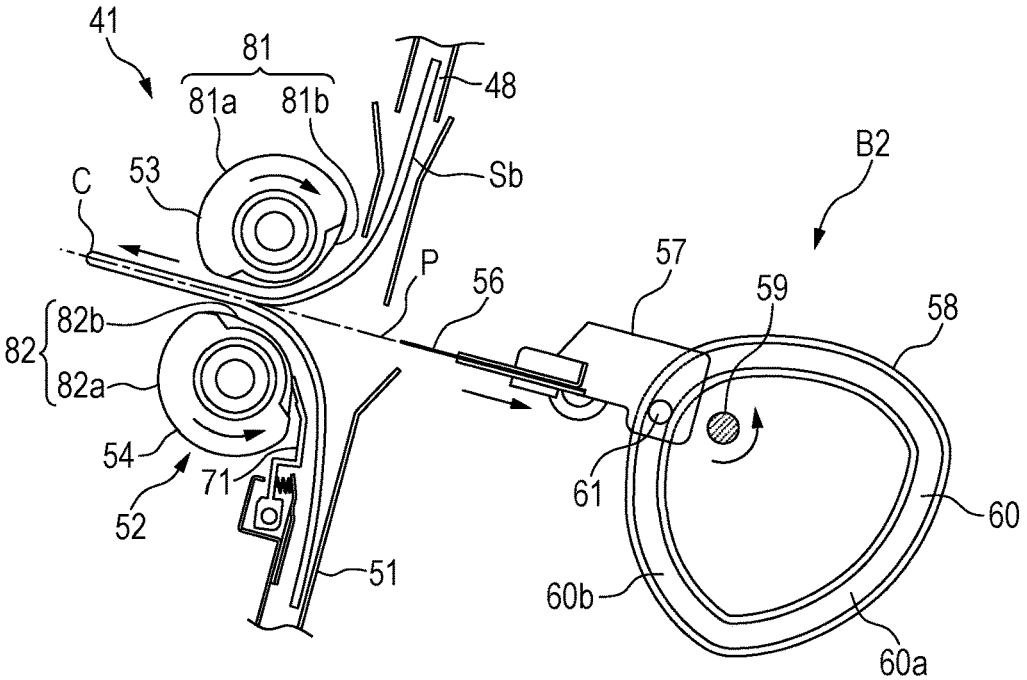

As illustrated in FIG. 15B, the cam member 58 is rotated again in the counter-clockwise direction, and at the same time, the folding roller pair 52 is rotated toward the conveyance direction. With this, the bundle of sheets Sb is nipped between the folding roller pair 52 and conveyed in the conveyance direction. Thus, second folding processing is performed. Through two successive folding processing performed as described above, the bundle of sheets Sb can be folded more securely and firmly. At that point of time, the folding roller pair 52 and the folding blade 56 (cam member 58) are rotated by 360°, that is, by one rotation from the initial state of FIG. 14A and returned to the state of FIG. 14A.

Figure 16A:
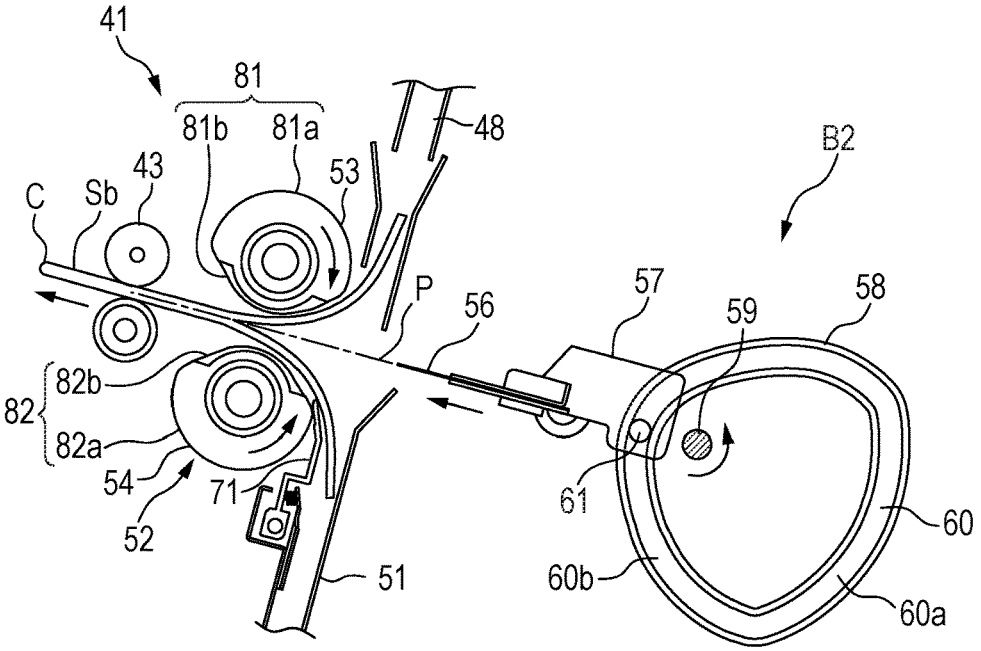
FIG. 16A and FIG. 16B are schematic explanatory views for illustrating steps of the folding processing on the bundle of sheets, which are subsequent to FIG. 15B.

After that, as illustrated in FIG. 16A, the cam member 58 is rotated by a slight angle in the counter-clockwise direction. With this, in the folding roller pair 52, the second roller surfaces 81*b* and 82*b* face each other at center positions thereof in the circumferential direction, thereby maximizing the gap between the folding rollers 53 and 54. The bundle of sheets Sb is nipped, at a leading edge side subjected to the folding processing, by the delivery roller pair 43 and delivered to the external stacking tray 44 from the apparatus housing 27. At this time, the folding rollers 53 and 54 are maximally separated, and the friction coefficient of the second roller surfaces 81*b* and 82*b* is low. Thus, a rear side portion of the bundle of sheets is guided by the second roller surface and conveyed out smoothly.

Figure 16B:
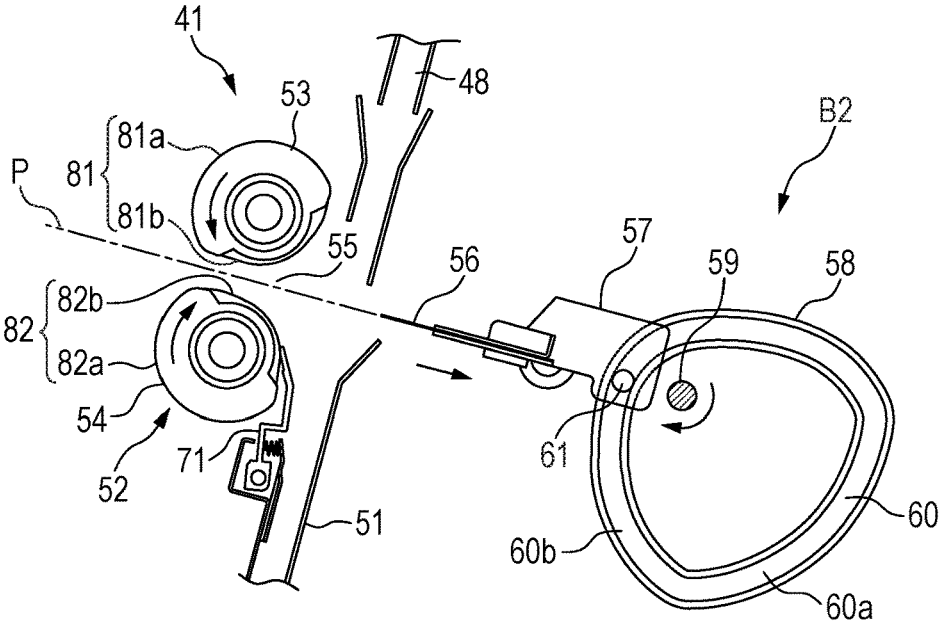

After conveyance of the bundle of sheets Sb having been subjected to the folding processing is completed, as illustrated in FIG. 16B, the cam member 58 is rotated by the slight angle in the clockwise direction to return to the initial state of FIG. 14A. The folding roller pair 52 is also returned to the initial state of FIG. 14A. With this, the second processing portion B2 is brought into a standby state of preparing for the next folding processing.

The series of folding processing operations described above are described in an illustrative manner with the folding processing device 41 of FIG. 3 in which the sheet guide member 71 is disposed on the side of the downstream folding roller 54. Thus, the series of folding processing operations are similarly applicable also to other embodiments illustrated in FIG. 9 to FIG. 13. Further, as a matter of course, the description of the folding processing operations does not limit the present invention at all.

In the sheet processing apparatus according to the above-mentioned embodiments, the guide portion is held in contact with at least one rotary member when the conveyed sheet is guided. Thus, the guide portion can be positioned accurately.

Further, the image forming system according to the above-mentioned embodiments includes the sheet processing apparatus. Thus, the image forming system can have the folding processing function which may suppress variation in position of the guide portion configured to prevent the conveyed sheet from being caught by the rotary member pair configured to perform the folding processing.

The present invention is described with reference to the embodiments. However, as a matter of course, the present invention is not limited to the embodiments described above, and can be changed or modified in various manners within the technical scope of the present invention. For example, for a spring as an urging member configured to urge the sheet guide member, various springs (elastic members) other than the compression coil spring can be used, and the sheet guide member can also be urged toward the direction of pulling toward the folding roller side. Further, the sheet guide member may be configured such that the member is entirely shifted (moved) toward the folding roller side rather than being swung.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2015-253414, filed Dec. 25, 2015, and 2015-253443, filed Dec. 25, 2015, which are hereby incorporated by reference herein in their entirety.

What is claimed is:

1. A sheet processing apparatus, comprising:

a conveyance path in which a sheet is conveyed in a predetermined conveyance direction;

a rotary member pair configured to nip a sheet conveyed in the conveyance path and rotate to convey while performing folding processing on the sheet, the rotary member pair having a first rotary member and a second rotary member, the first rotary member having a first circumferential surface part and a second circumferential surface part, a distance from the first circumferential surface part to a rotary shaft center of the first rotary member being longer than a distance from the second circumferential surface part to the rotary shaft center of the first rotary member, the second rotary member having a third circumferential surface part and a fourth circumferential surface part, a distance from the third circumferential surface part to a rotary shaft center of the second rotary member being longer than a distance from the fourth circumferential surface part to the rotary shaft center of the second rotary member; and a guide portion provided between the first rotary member and the conveyance path and configured to guide a downstream edge of a sheet conveyed in the predetermined conveyance direction, wherein, in a case that a sheet is conveyed to the conveyance path, the second circumferential surface part and the fourth circumferential surface part are set so as to be oriented toward the conveyance path, wherein, in a case that the sheet is conveyed in the conveyance path in the predetermined conveyance direction, the guide portion guides a downstream edge of the sheet in the predetermined conveyance direction in a state in which the guide portion is held in contact with the second circumferential surface part, and in a case that the rotary member pair rotates to convey the sheet, the guide portion guides the sheet in a state in which the guide portion is held in contact with the first circumferential surface part, and wherein the guide portion is configured to be movable to a first position at which the guide portion is held in contact with the first circumferential surface part and to a second position at which the guide portion is held in contact with the second circumferential surface part.

2. A sheet processing apparatus according to claim 1, wherein the guide portion is urged so as to be always in slide contact with a circumferential surface of the first rotary member being rotated.

3. A sheet processing apparatus according to claim 1, wherein the guide portion is provided so as to cover a part, which is closest to the conveyance path, of a circumferential surface of the first rotary member.

4. A sheet processing apparatus according to claim 1, wherein the guide portion is provided so that a tip end of the guide portion is swingable.

5. A sheet processing apparatus according to claim 1, wherein the first rotary member is provided downstream of the second rotary member in the predetermined conveyance direction.

6. A sheet processing apparatus according to claim 1, further comprising an alignment unit configured to align a sheet in the conveyance path in a direction crossing the predetermined conveyance direction.

7. An image forming system, comprising:

an image forming unit configured to form an image on a sheet; and a sheet processing apparatus configured to perform folding processing on a sheet conveyed from the image forming unit, the sheet processing apparatus comprising:

a conveyance path in which a sheet is conveyed in a predetermined conveyance direction;

a rotary member pair configured to nip a sheet conveyed in the conveyance path and rotate to convey while performing the folding processing on the sheet, the rotary member pair having a first rotary member and a second rotary member, the first rotary member having a first circumferential surface part and a second circumferential surface part, a distance from the first circumferential surface part to a rotary shaft center of the first rotary member being longer than a distance from the second circumferential surface part to the rotary shaft center of the first rotary member, the second rotary member having a third circumferential surface part and a fourth circumferential surface part, a distance from the third circumferential surface part to a rotary shaft center of the second rotary member being longer than a distance from the fourth circumferential surface part to the rotary shaft center of the second rotary member; and a guide portion disposed between the first rotary member and the conveyance path and configured to guide a downstream edge of a sheet conveyed in the predetermined conveyance direction, wherein, in a case that a sheet is conveyed to the conveyance path, the second circumferential surface part and the fourth circumferential surface part are set so as to be oriented toward the conveyance path, wherein, in a case that the sheet is conveyed in the conveyance path in the predetermined conveyance direction, the guide portion guides a downstream edge of the sheet in the predetermined conveyance direction in a state in which the guide portion is held in contact with the second circumferential surface part, and in a case that the rotary member pair rotates to convey the sheet, the guide portion guides the sheet in a state in which the guide portion is held in contact with the first circumferential surface part, and wherein the guide portion is configured to be movable to a first position at which the guide portion is held in contact with the first circumferential surface part and to a second position at which the guide portion is held in contact with the second circumferential surface part.

* * * * *